US010788190B2

(12) United States Patent
Signoretto et al.

(10) Patent No.: US 10,788,190 B2
(45) Date of Patent: Sep. 29, 2020

(54) LIGHT SOURCE UNIT

(71) Applicant: Sharp Kabushiki Kaisha, Osaka (JP)

(72) Inventors: Mattia Signoretto, Oxford (GB); Karl Peter Welna, Oxford (GB); Valerie Berryman-Bousquet, Oxford (GB); Koji Takahashi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 16/690,604

(22) Filed: Nov. 21, 2019

(65) Prior Publication Data

US 2020/0166197 A1 May 28, 2020

Related U.S. Application Data

(60) Provisional application No. 62/772,191, filed on Nov. 28, 2018.

(51) Int. Cl.
*F21V 9/32* (2018.01)
*F21V 29/87* (2015.01)
*F21V 7/22* (2018.01)

(52) U.S. Cl.
CPC ..... *F21V 9/32* (2018.02); *F21V 7/22* (2013.01); *F21V 29/87* (2015.01)

(58) Field of Classification Search
CPC ..... F21V 9/30; F21V 9/32; F21V 9/35; F21V 9/40; F21S 41/16; F21S 41/176
See application file for complete search history.

(56) References Cited

U.S. PATENT DOCUMENTS 10,443,800 B2 * 10/2019 Hechtfischer ..... F21S 41/16
2012/0104934 A1 * 5/2012 Fukai ..... F21S 41/16 313/498
2012/0106185 A1 * 5/2012 Kishimoto ..... F21S 41/176 362/510
2013/0003347 A1 * 1/2013 Maemura ..... H01L 33/644 362/84
2013/0182452 A1 * 7/2013 Takahira ..... F21S 41/24 362/510
2013/0314937 A1 * 11/2013 Takahashi ..... F21S 41/16 362/538
2015/0062943 A1 * 3/2015 Takahira ..... F21S 41/285 362/510
2015/0102722 A1 * 4/2015 Ohbayashi ..... F21S 41/16 313/498
2019/0257488 A1 * 8/2019 Hechtfischer ..... F21V 29/70

FOREIGN PATENT DOCUMENTS

WO WO 2018/001813 1/2018

* cited by examiner

*Primary Examiner* — William N Harris
(74) *Attorney, Agent, or Firm* — Renner, Otto, Boiselle & Sklar, LLP

(57) ABSTRACT

A light source unit provides enhanced control of a colour shift of white light reflected by a retro-reflector. The light source unit includes a pump light source, which emits laser pump light, a phosphor, which converts the laser pump light into white light, a retro-reflector, which has an output aperture that allows emission of part of the white light, the retro-reflector reflecting another part of the white light back to the phosphor, and scattering particles, which are adjusted to increase a blue light ratio of the white light.

16 Claims, 16 Drawing Sheets

1: LIGHT SOURCE UNIT
2: PUMP LIGHT SOURCE
3: PHOSPHOR
4: RETRO-REFLECTOR
5: OUTPUT APERTURE
10: SUBSTRATE
11: LASER PUMP LIGHT
12: WHITE LIGHT
13: EMITTED LIGHT
14: CONVERTER
15: COUPLING APERTURE

3: PHOSPHOR
7: SCATTERING PARTICLE
10: SUBSTRATE
14: CONVERTER (a)

(b)

(c)

| α | Y0 [K] | A1 [K] | t1 | A2 [K] | t2 |
|---|---|---|---|---|---|
| 15 | $2.5\cdot10^{3}$ | $1.1\cdot10^{3}$ | 8.0 | 2.8 | 1.6 |
| 30 | $4.2\cdot10^{3}$ | 67 | 1.1 | 67 | 1.1 |
| 40 | $-3.6\cdot10^{7}$ | $3.6\cdot10^{7}$ | $4.9\cdot10^{4}$ | 57 | $6.7\cdot10^{-1}$ |
| 50 | $4.7\cdot10^{5}$ | $1.1\cdot10^{-1}$ | $2.4\cdot10^{-1}$ | $-4.6\cdot10^{5}$ | $-2.1\cdot10^{2}$ |
| 60 | $2.6\cdot10^{3}$ | $1.3\cdot10^{-4}$ | $1.0\cdot10^{-1}$ | $1.3\cdot10^{3}$ | 1.2 |
| 70 | $-1.9\cdot10^{3}$ | $5.8\cdot10^{-4}$ | $1.1\cdot10^{-1}$ | $4.5\cdot10^{3}$ | 1.9 |
| 80 | $4.5\cdot10^{3}$ | 86 | $4.3\cdot10^{-1}$ | 86 | $4.3\cdot10^{-1}$ |
| 90 | $4.9\cdot10^{3}$ | 65 | $3.8\cdot10^{-1}$ | 65 | $3.8\cdot10^{-1}$ |

1: LIGHT SOURCE UNIT
2: PUMP LIGHT SOURCE
3: PHOSPHOR
4: RETRO-REFLECTOR
5: OUTPUT APERTURE
10: SUBSTRATE
11: LASER PUMP LIGHT
12: WHITE LIGHT
13: EMITTED LIGHT
14: CONVERTER
15: COUPLING APERTURE

LIGHT SOURCE UNIT

TECHNICAL FIELD

The present invention relates to a light source unit including a phosphor, which converts a laser beam emitted from a pump light source into emitted light, and a retro-reflector, which has an output aperture that allows emission of part of the emitted light obtained after being converted by the phosphor and which reflects another part of the emitted light to a light converter layer.

BACKGROUND ART

A light source unit including a laser pump light source, a phosphor, and a dome-shaped retro-reflector is known (PTL 1). This light source unit includes a laser pump light source, which emits laser pump light, a phosphor, which converts the laser pump light into wavelength-converted light (fluorescence), and a retro-reflector, which is joined to the phosphor and has an output aperture that allows emission of part of the wavelength-converted light (fluorescence). The retro-reflector reflects another part of the wavelength-converted light (fluorescence) back to the phosphor.

CITATION LIST

Patent Literature

[PTL 1] International Publication No. WO2018/001813 (disclosed on Jan. 4, 2018)

SUMMARY OF INVENTION

Technical Problem

However, the light source unit described in PTL 1 has the following problem.

The phosphor included in the light source unit typically emits emitted light in Lambertian angular distribution, and is generally composed of particles (for example, cerium-doped yttrium aluminum garnet (YAG)) that absorb blue light and emit a broad wavelength range of wavelength-converted light from green to red. These particles not only absorb blue light hitting those particles but also scatter the light. Specifically, when the phosphor is irradiated with a blue laser beam, a broad wavelength range of light from green to red, which is wavelength-converted light, is mixed with the scattered blue laser beam, so that white light is emitted.

To emit light in Lambertian angular distribution, large optics are required to highly efficiently use the light. To highly efficiently use the emitted light with small optics, a pump light source that emits light at a smaller angle than the Lambertian distribution is preferable.

A retro-reflector with an output aperture of an angle $2\alpha$ functions to return the wavelength-converted light back and the laser beam scattered by the phosphor at an angle larger than $2\alpha$ again onto the phosphor. The laser beam and wavelength-converted light returned to the phosphor are again absorbed or scattered by the phosphor and re-emitted from the phosphor.

White light reflected off the retro-reflector is incident again on the phosphor at an angle within the range of 0 degrees to 90 degrees, and is re-emitted from the phosphor as white light in Lambertian distribution.

The inventors have found that white light (mixture of scattered laser beam and wavelength-converted light) emitted when the phosphor is excited by a laser beam in a structure not including a retro-reflector has a colour temperature different from that of white light emitted when the phosphor is excited by a laser beam in a structure including a retro-reflector. White light emitted when the phosphor is excited by a laser beam in a structure including a retro-reflector has a lower colour temperature (that is, the light exhibits a red shift in color). This shift of the colour temperature to a lower colour temperature in a structure including the retro-reflector is not desirable in the application of the light source unit to, for example, car headlights.

This shift of the colour temperature to a lower colour temperature in a structure including the retro-reflector is dependent on the dimension (angle $2\alpha$) of the output aperture of the retro-reflector. This is because the output aperture having a smaller size allows more white light to be reflected by the retro-reflector, so that more blue light is absorbed by the phosphor.

Use of the retro-reflector changes the colour temperature of white obtained by mixing the scattered laser beam and the wavelength-converted light from the colour temperature of white emitted from a structure not including the retro-reflector. White light reflected by the retro-reflector is directed again onto the phosphor, and components of the scattered laser beam in the white light are absorbed again by the phosphor to form wavelength-converted light. On the other hand, components of the wavelength-converted light in the white light that have been returned to the phosphor are scattered again or absorbed without being subjected to wavelength conversion again. Thus, it is assumed that, every time white light is returned to the phosphor by being reflected by the retro-reflector, components of blue-color wavelength corresponding to the scattered laser beam are deducted from the white light, so that the colour temperature gradually decreases.

PTL 1 describes a change of the characteristics of a dome-shaped retro-reflector and the wavelength of laser pump light to solve the above problem.

However, associating the wavelength of the laser pump light with the characteristics of the retro-reflector causes inconvenience in color mixture, and reducing the wavelength of the laser pump light degrades the system efficiency.

An aspect of the present invention is to provide a light source unit that includes a retro-reflector and that is capable of emitting preferable white light.

Solution to Problem (1) An embodiment of the present invention is a light source unit that includes a pump light source that emits a laser beam; a phosphor that converts the laser beam emitted from the pump light source into converted light; and a retro-reflector that has an output aperture, which allows emission of part of the converted light converted by the phosphor as emitted light, the retro-reflector reflecting another part of the converted light back to the phosphor as retro-reflection light. The phosphor includes a blue-light-ratio increasing member, which increases the blue light ratio of the converted light.

(2) An embodiment of the present invention provides a light source unit having the structure described in the paragraph (1), in which the blue-light-ratio increasing member is scattering particles included in the phosphor to diffusely reflect or scatter the laser beam emitted from the pump light source.

(3) An embodiment of the present invention provides a light source unit having the structure described in the paragraph (1), in which the scattering particles are formed from a high thermal conductivity material to improve the thermal properties of the phosphor.

(4) An embodiment of the present invention provides a light source unit having the structure described in the paragraph (1), in which the blue-light-ratio increasing member is the phosphor having a particle density adjusted in accordance with a size of an output aperture of the retro-reflector.

(5) An embodiment of the present invention provides a light source unit having the structure described in the paragraph (1), in which the blue-light-ratio increasing member is a scattering layer disposed on a surface of the light converter layer facing the pump light source to diffusely reflect or scatter the laser beam emitted from the pump light source.

(6) An embodiment of the present invention provides a light source unit having the structure described in the paragraph (1), in which the blue-light-ratio increasing member is scattering particles disposed on a surface of the phosphor facing the pump light source to diffusely reflect or scatter the laser beam emitted from the pump light source.

(7) An embodiment of the present invention provides a light source unit having the structure described in the paragraph (1), that further includes a substrate that supports the phosphor, and in which the blue-light-ratio increasing member is constituted of a combination the substrate and the phosphor into a geometric pattern.

(8) An embodiment of the present invention provides a light source unit and having the structure described in the paragraph (1), in which a desired colour temperature of the emitted light is greater than or equal to 2000 K and smaller than or equal to 10000 K.

(9) An embodiment of the present invention provides a light source unit having the structure described in the paragraph (1), in which the retro-reflector has a hollow dome shape or a flat plate shape.

(10) An embodiment of the present invention provides a light source unit having the structure described in the paragraph (1), in which the retro-reflector is coupled to the phosphor directly or via an intermediate layer.

(11) An embodiment of the present invention provides a light source unit having the structure described in the paragraph (1), in which the blue light ratio increased by the blue-light-ratio increasing member is determined by a formula relating to the desired colour temperature and the size of the output aperture.

(12) An embodiment of the present invention provides a light source unit having the structure described in the paragraph (1), that further includes a different pump light source that emits a different laser beam, and in which the phosphor converts the laser beam emitted from the pump light source and the different laser beam emitted from the different pump light source into the emitted light.

Advantageous Effects of Invention

An aspect of the present invention provides a light source unit including a retro-reflector and capable of emitting preferable white light.

DESCRIPTION OF EMBODIMENTS

Embodiments of the present invention will be described in detail, below. To solve the above problem, embodiments of the present invention each provide a structure that controls the colour temperature of white emitted light emitted from a structure including a retro-reflector to a desired colour temperature. Thus, the colour temperature of white light emitted from the phosphor itself (emitted without using a retro-reflector) is intentionally increased to solve the problem. A light source unit according to one embodiment may include a substrate and a wavelength converter that includes a phosphor formed from multiple different materials, and the phosphor may have a coating applied to its surface.

The phosphor according to any of embodiments of the present application emits white light having a high colour temperature, which is a blue colour temperature, when used without a retro-reflector. White light having a high colour temperature without a retro-reflector can be obtained by improving the internal structure of the phosphor, additionally disposing, on the upper surface of the phosphor, a structure that further scatters a blue laser beam, or by changing the geometric shape of the substrate.

Thus, the blue component of the finally emitted light obtained when a retro-reflector is used can be increased.

Embodiment 1

(Structure of Light Source Unit 1)

Figure 1:
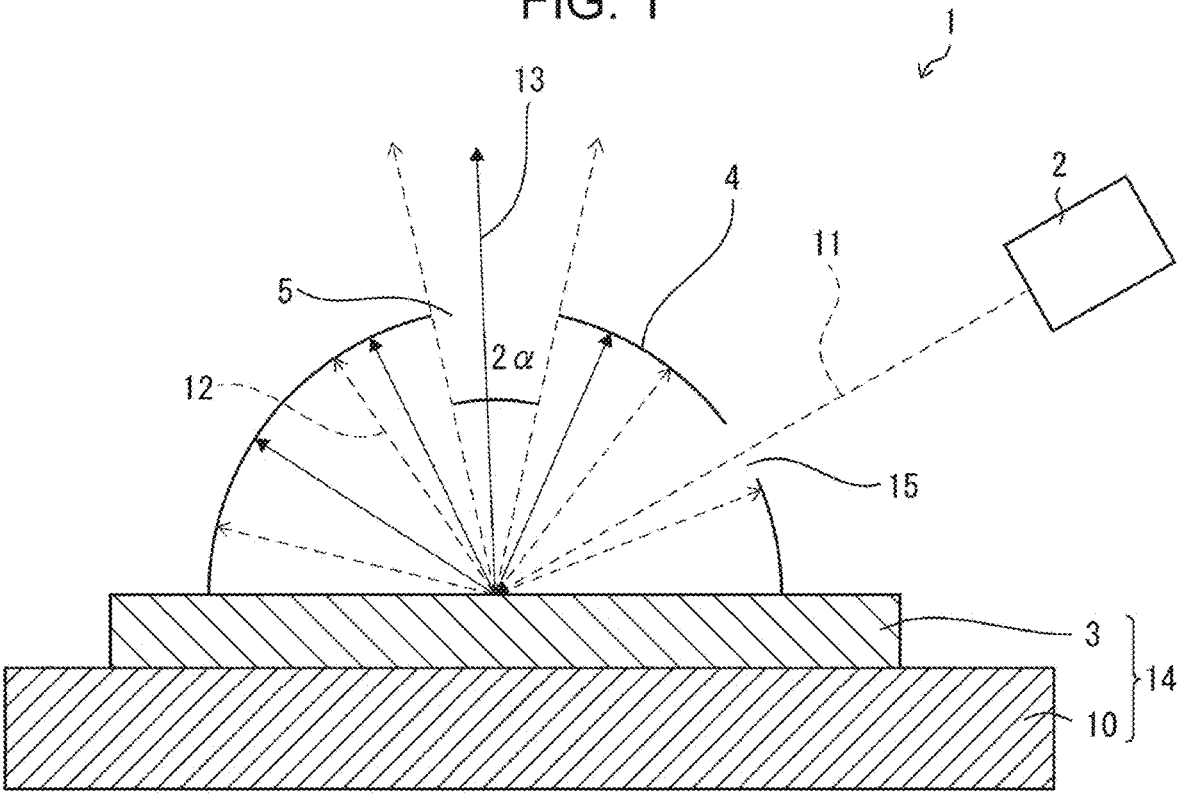
FIG. 1 is a schematic cross-sectional view of a light source unit according to Embodiment 1.

FIG. 1 is a schematic cross-sectional view of a light source unit 1 according to Embodiment 1. The light source unit 1 includes a pump light source 2, which emits laser pump light 11 (laser beam), a plate-shaped phosphor 3, which converts the laser pump light 11 emitted from the pump light source 2 into white light 12 (converted light), which is a mixture of a scattered laser beam and fluorescence, and a dome-shaped (hollow dome-shaped) retro-reflector 4, which has an output aperture 5 that allows emission of part of the white light 12 converted by the phosphor 3 as emitted light 13, the retro-reflector 4 reflecting another part of the white light 12 back to the phosphor 3 as retro-reflection light.

The phosphor 3 is supported by a substrate 10. The substrate 10 and the phosphor 3 constitute a converter 14.

The retro-reflector 4 has a coupling aperture 15, which guides the laser pump light 11 emitted from the pump light source 2 to the phosphor 3.

Figure 2:
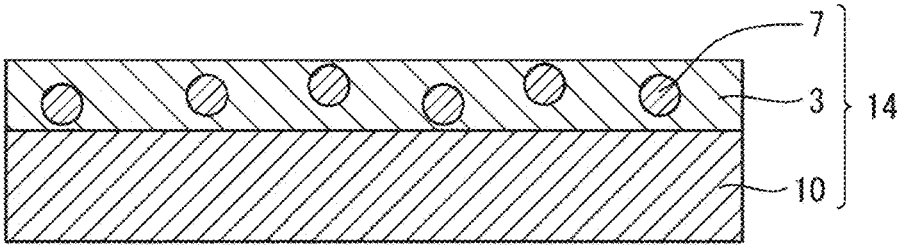
FIG. 2 is a cross-sectional view of a converter disposed on the light source unit.

FIG. 2 is a cross-sectional view of the converter 14 included in the light source unit 1. The phosphor 3 includes scattering particles 7 (blue-light-ratio increasing member) that scatter the laser pump light 11 emitted from the pump light source 2 to increase the colour temperature (correlated color temperature (CCT)) of the phosphor 3.

The pump light source 2 includes a laser diode that emits the laser pump light 11, and a lens disposed between a laser diode and the coupling aperture 15 of the retro-reflector 4 to further collimate and/or condense the laser pump light 11. The lens may change the light intensity distribution of the laser pump light 11.

The phosphor 3 is mounted on the substrate 10, and preferably formed from, for example, YAG and a binder (binding member) as a material. The substrate 10 may be preferably formed from aluminium, copper, ceramics, or other materials having high thermal conductivity.

The retro-reflector 4 has a hollow dome shape, and has a highly reflective inner peripheral surface. The retro-reflector 4 may be formed from a glass that transmits visible light, BK7, or other materials. In this example, the retro-reflector 4 may be mounted in contact with the phosphor 3. The phosphor 3 may have high thermal conductivity. A gap may be left between the phosphor 3 and an end surface of the hollow dome-shaped retro-reflector 4 facing the phosphor 3.

The coupling aperture 15 may have any shape. The coupling aperture 15 needs to have a size greater than the size of the laser pump light 11 not to interfere with the optical path of the laser pump light 11.

The output aperture 5 preferably has a circular shape, but may have any of other shapes including a square or rectangular shape.

The laser pump light 11 has a peak emission wavelength shorter than the peak emission wavelength of fluorescence emitted from the phosphor 3. A general application of the light source unit 1 is an illumination that emits white light. The phosphor 3 is made of YAG or other wavelength converting materials with similar properties, and the peak emission wavelength of the laser pump light 11 is preferably on or around 450 nm.

The scattering particles 7 are added to the phosphor 3 to scatter the blue laser pump light 11.

In the embodiment illustrated in FIG. 2, the phosphor 3 may be made of YAG or another phosphor conversion material, and may or may not contain a binder material and/or another scattering material. The phosphor 3 can be deposited or printed on the substrate 10, and has a mixture of phosphor particles and some other scattering particles. Some binding material can be included. The phosphor 3 can be made of multiple layers including a phosphor material layer and some other scattering material layers. The scattering material layer can be ceramic or a crystalline structure.

The scattering particles 7 may include different materials, such as, $Al_2O_3$, diamond, and $TiO_2$. The scattering particles 7 are made of a material having very low absorption of the light in the visible range. The scattering particles 7 may be made of high thermal conductivity materials to improve the thermal properties of the phosphor 3.

A problem usually occurs when the scattering particles 7 are used alone without the retro-reflector. This is because the scattering particles 7 decrease the wavelength conversion efficiency of the phosphor 3, increase the size of the emission spot of the phosphor 3, and worsen the color mixing. However, when the retro-reflector 4 and the scattering particles 7 are used in combination, these problems can be partially or completely suppressed. Thanks to the recycling of the white light 12 due to reflection at the inner peripheral surface of the retro-reflector 4, the color homogeneity will be improved and the excessive absorption of the blue light will be decreased, so that a desired colour temperature can be obtained.

(Solution Principle of Problem)

The laser pump light 11 emitted from the pump light source 2 passes through the coupling aperture 15 to the inside of the retro-reflector 4 to be incident on the phosphor 3. Part of the white light 12, which is the mixture of a scattered laser beam emitted from the phosphor 3 and fluorescence, is emitted through the output aperture 5 of the retro-reflector 4 as the emitted light 13, and another part is reflected off the inner peripheral surface of the retro-reflector 4 back to the phosphor 3 as retro-reflection light. The reflected retro-reflection light can be scattered by the phosphor 3 to be added to the emitted light 13 and directed to the output aperture 5. This can be said as a basic structure used to reduce an etendue of the pump light source 2.

This white light 12 has a problem on the colour temperature. The white light 12 is formed from the laser pump light 11 and the converted light converted by the phosphor 3. When the white light 12 hits the phosphor 3 as retro-reflection light reflected by the retro-reflector 4, the retro-reflection light is absorbed or scattered by the phosphor 3, and is partially subjected to wavelength conversion.

However, when the retro-reflection light reflected by the retro-reflector 4 hits the phosphor 3, the blue light component contained in the retro-reflection light is absorbed by the phosphor 3, and the retro-reflection light has its wavelength converted and is then added to the emitted light 13 emitted through the output aperture 5. Thus, the emitted light 13 emitted through the output aperture 5 becomes more yellowish (colour temperature decreases). The more cycles of the white light 12 reflected off the inner peripheral surface of the retro-reflector 4 and returned to the phosphor 3 as retro-reflection light take place, the more yellow the emitted light 13 emitted through the output aperture 5 becomes. The emitted light 13 becomes more yellowish as the size of the output aperture 5 decreases.

To solve this problem, the present invention proposes to increase the ratio of the laser pump light 11 converted to the white light 12 after the laser pump light 11 has hit the phosphor 3, and to have the phosphor 3 that emits more blueish light with reduction of the blue light absorption of the phosphor 3 to keep preferable wavelength conversion efficiency. In other words, the white light 12 inside the retro-reflector 4 is adjusted to emit white light having a higher colour temperature than the light emitted by only the phosphor 3 without the retro-reflector 4. Thus, a colour temperature shift due to the increase of the blue light absorption of the phosphor 3 in the recycling of the white light 12 due to reflection at the inner peripheral surface of the retro-reflector 4 is compensated.

In the present embodiment, the blue light component in the white light 12 is increased by modifying the internal structure of the phosphor 3.

Figure 3:
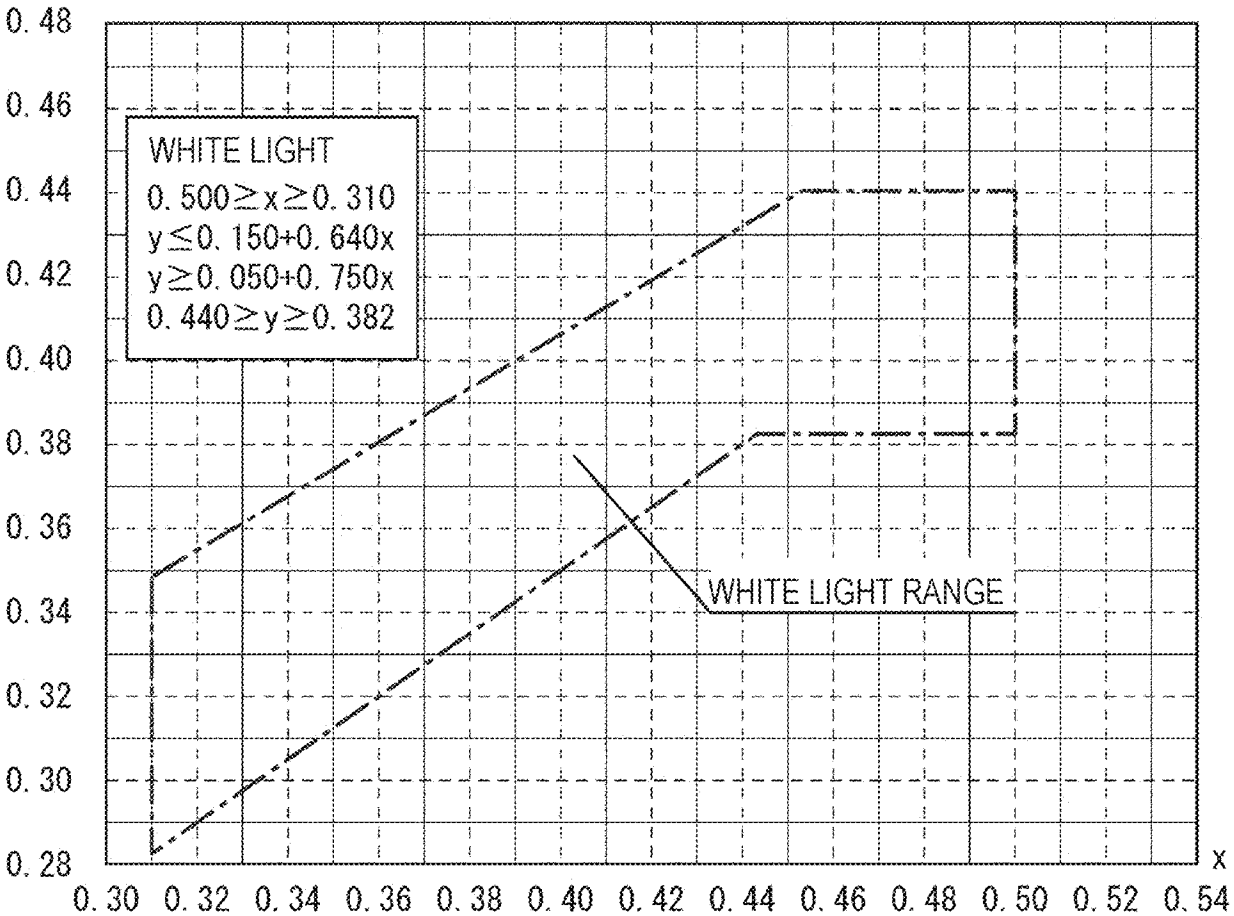
FIG. 3 is a graph illustrating that white light is required for a car headlight on which the light source unit is mounted.

FIG. 3 is a graph illustrating that a car headlight on which the light source unit 1 is mounted is required to emit white light. In automotive headlights, European automotive standards (UNECE) and US regulation require headlamps to emit white light. In the example of the light source unit 1 according to the present embodiment being used in automotive application for headlights, it is desirable that the emitted light 13 emitted from the retro-reflector 4 meets those requirements. It is also generally preferred that white light has a colour temperature on or around 6000 K. White light for headlights is defined by the area indicated by a dot-and-dash line in FIG. 3. In applications other than car headlights, the requirements for the colour temperature and the chromaticity coordinates (x, y) will vary.

Figure 4:
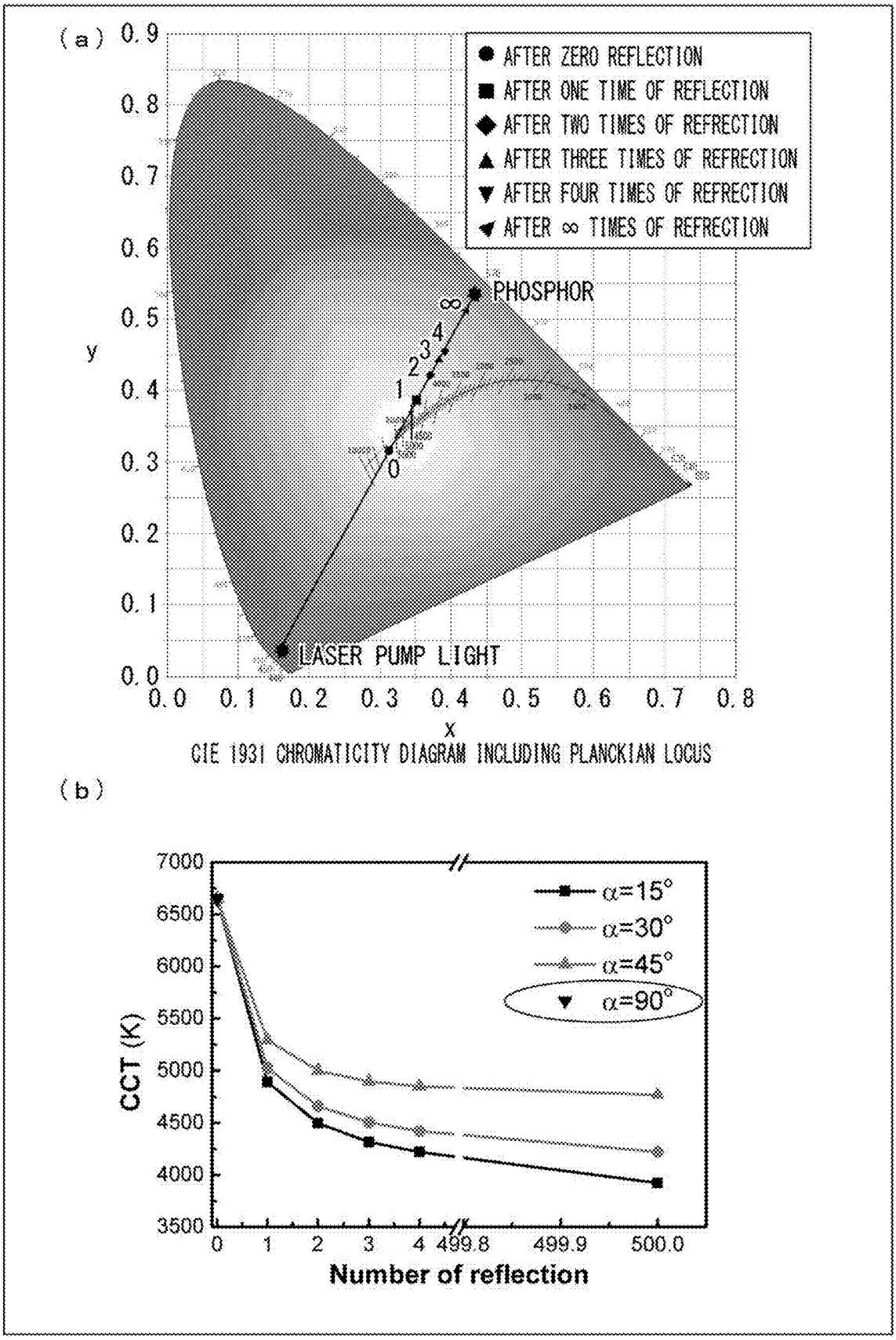
FIG. 4(*a*) is a chromaticity diagram that illustrates a cause of a problem of the light source unit to be solved, and FIG. 4(*b*) is a graph illustrating the relationship between the number of reflection performed by the retro-reflector of the light source unit and the colour temperature (CCT) for the above problem.

FIG. 4(*a*) is a chromaticity diagram illustrating the principle of the problem of the light source unit 1 to be solved, and FIG. 4(*b*) is a graph showing the relationship between the colour temperature (CCT) and the number of reflection of the white light 12 performed by the retro-reflector 4 in relation to the above problem.

When the white light 12 is reflected between the phosphor 3 and the retro-reflector 4 to be returned to the phosphor 3, the phosphor 3 absorbs blue light, but does not absorb yellow light. As the number of reflection increases, the more yellowish emitted light 13 is emitted through the output aperture 5 of the retro-reflector 4.

The colour temperature (CCT) of the emitted light 13 emitted through the output aperture 5 decreases as the number of reflection increases, as illustrated in FIG. 4(*b*), and, as illustrated in FIG. 4(*a*), the chromaticity coordinates (x, y) for the emitted light 13 emitted through the output aperture 5 shift away from a Planckian locus (blackbody locus) as the number of reflection increases. The angle $\alpha=90°$ corresponds to the case where the retro-reflector 4 is not provided, in which the recycling between the phosphor 3 and the retro-reflector 4 does not occur, so that the number of reflection is zero.

Figure 5:
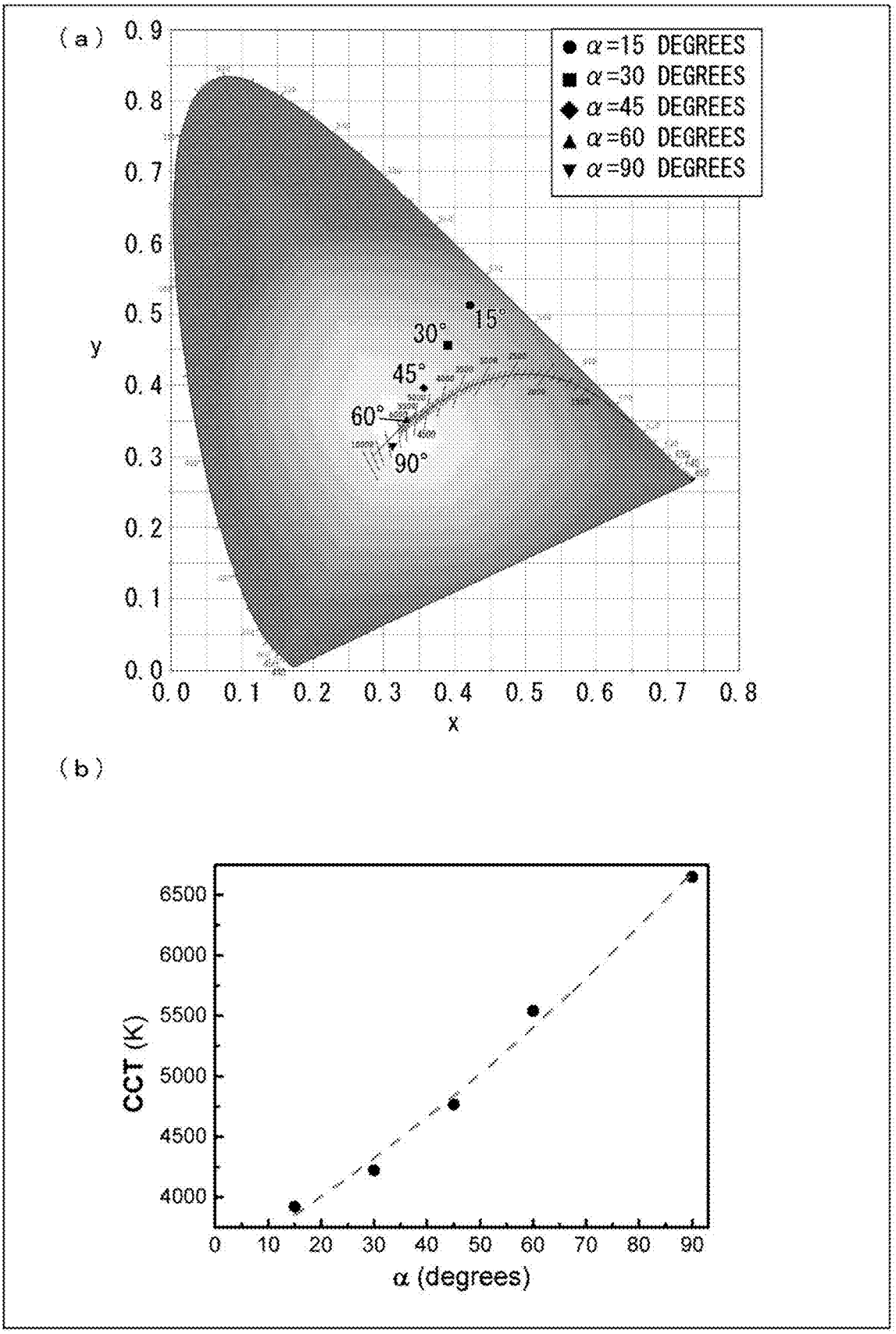
FIG. 5(*a*) is another chromaticity diagram that illustrates a cause of the problem to be solved, and FIG. 5(*b*) is a graph illustrating the relationship between the dimension of the output aperture of the retro-reflector disposed on the light source unit and the colour temperature (CCT).

FIG. 5(*a*) is another chromaticity diagram illustrating the principle of the problem to be solved, and FIG. 5(*b*) is a graph illustrating the relationship between the size of the output aperture 5 of the retro-reflector 4 included in the light source unit 1 and the colour temperature (CCT).

When an angle $\alpha$, representing the size of the output aperture 5 of the retro-reflector 4, is changed, the chromaticity coordinates (x, y) and the final colour temperature (CCT) of the emitted light 13 emitted through the output aperture 5 are changed. As the angle $\alpha$ of the output aperture 5 becomes smaller, the colour temperature (CCT) of the emitted light 13 from the output aperture 5 further decreases, as illustrated in FIG. 5(*b*), so that the emitted light 13 from the output aperture 5 becomes more yellowish. The angle $\alpha=90°$ corresponds to the case of including no retro-reflector 4.

Figure 6:
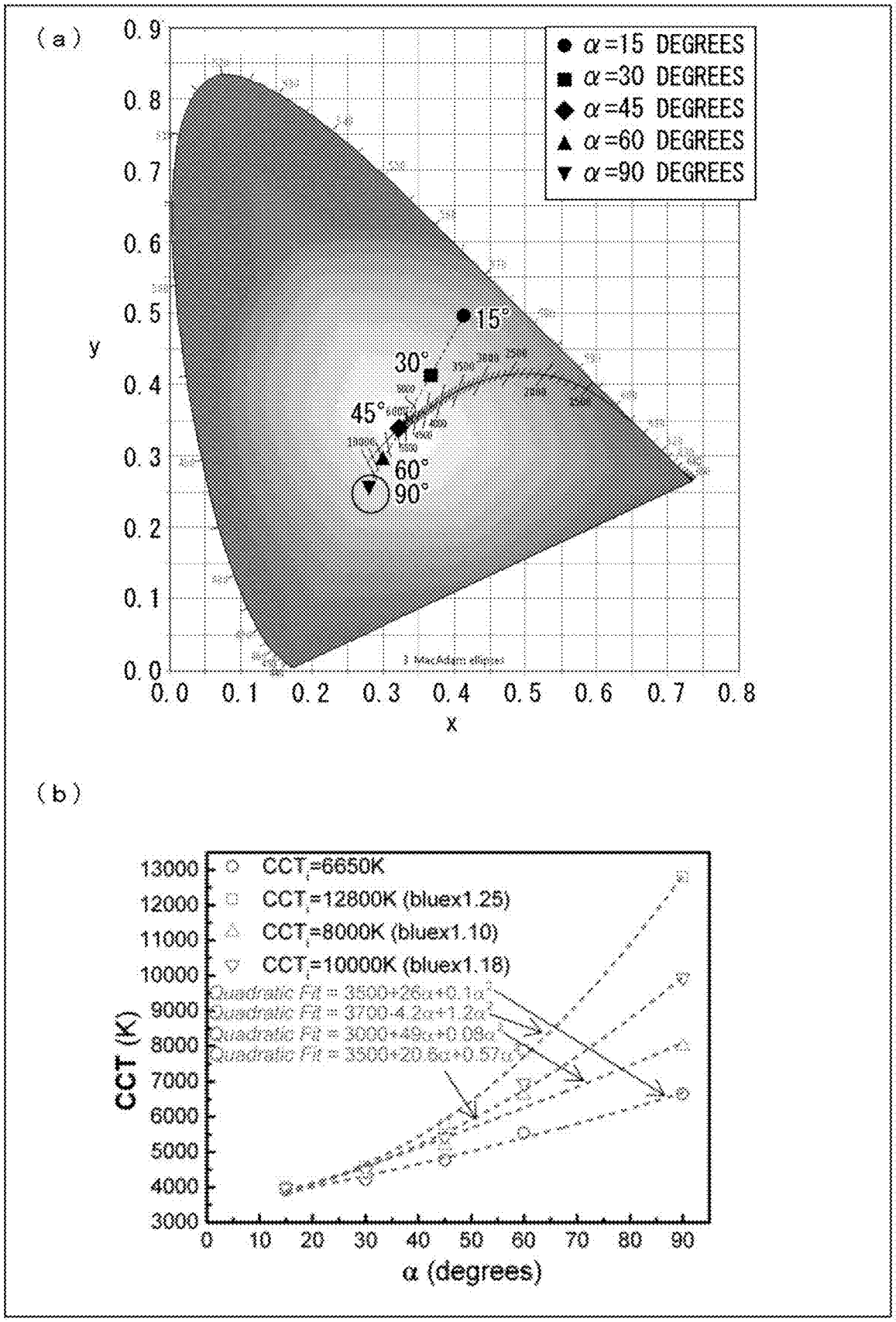
FIG. 6(*a*) is another chromaticity diagram that illustrates a cause of the problem to be solved, and FIG. 6(*b*) is another graph illustrating the relationship between the dimension of the output aperture and the colour temperature (CCT).
Figure 7:
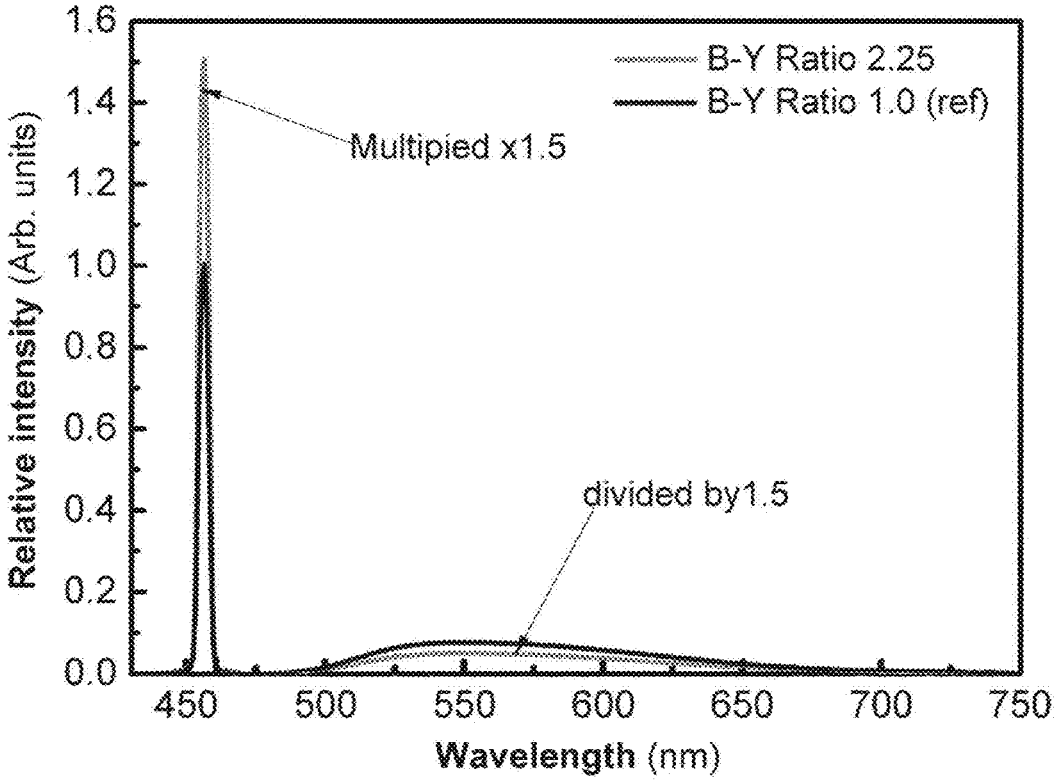
FIG. 7 is a graph of relative intensity relative to the wavelength of emitted light for relative emitted light beams having different ratios of blue light to yellow light.
Figure 8:
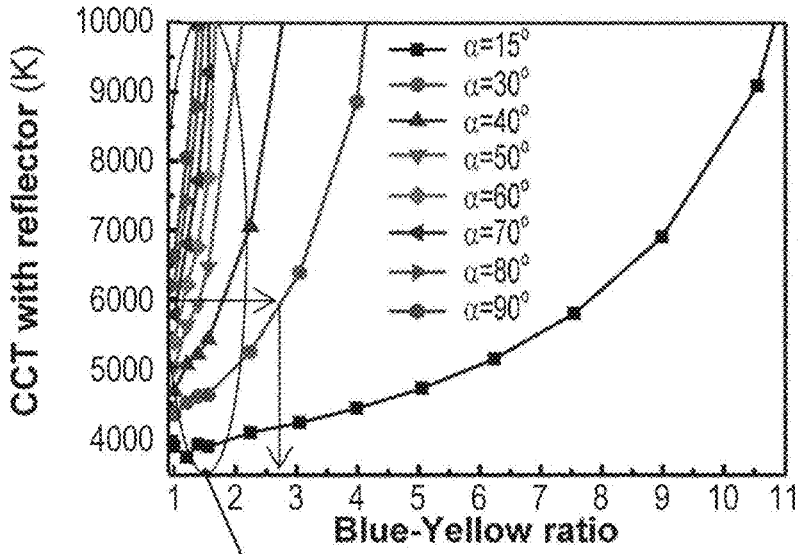
FIGS. 8(*a*) and 8(*b*) are graphs of the relationship between the ratio of blue light relative to yellow light of emitted light and the colour temperature (CCT), and FIG. 8(*c*) illustrates the values of the factors in a formula representing the relationship between the ratio of blue light relative to yellow light of the emitted light and the colour temperature (CCT) for each size of the output aperture of the retro-reflector.
Figure 8:
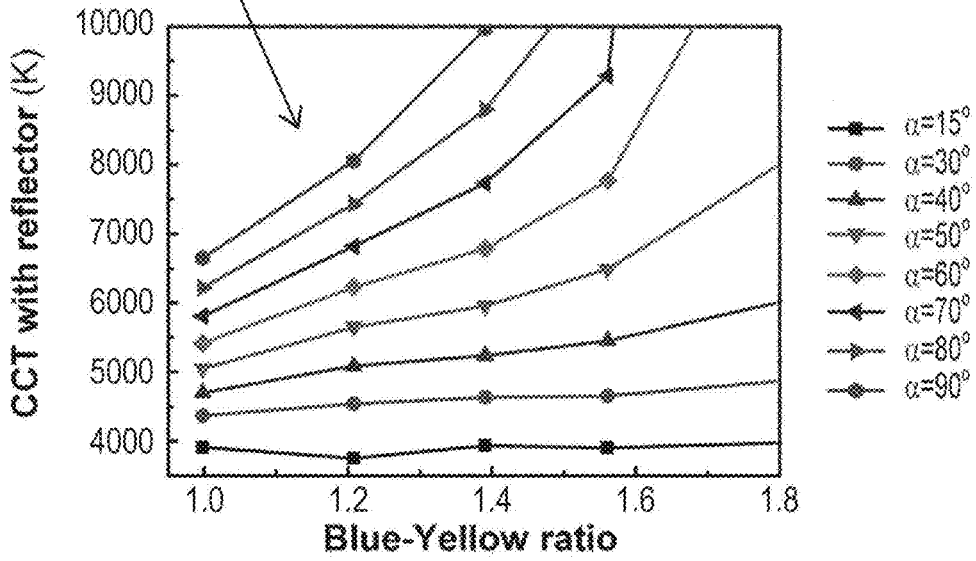

FIG. 6(*a*) is another chromaticity diagram illustrating the principle of the problem to be solved, and FIG. 6(*b*) is another graph illustrating the relationship between the size of the output aperture 5 and the colour temperature (CCT). FIG. 7 is a graph of relative intensity relative to the wavelength of the emitted light 13 for emitted light beams having different ratios of blue light to yellow light. FIGS. 8(*a*) and 8(*b*) are graphs of the relationship between the ratio of blue light relative to yellow light of the emitted light 13 and the colour temperature (CCT), and FIG. 8(*c*) illustrates the values of the factors in a formula representing the relationship between the ratio of blue light relative to yellow light of the emitted light 13 and the colour temperature (CCT) for each size of the output aperture 5 of the retro-reflector 4.

With reference to FIG. 7, the white light 12 with a colour temperature (CCT) of 6500 K is chosen as the reference spectra so the ratio of blue to yellow light (B-Y) ratio=1. To simulate an increase of the blue light in the white light 12 from the phosphor 3, the blue light part (wavelength $\lambda<475$ nm) of the reference spectra is multiplied by a factor x (x=1.5 in the example illustrated in FIG. 7). The yellow light part (wavelength $\lambda>475$ nm) of the reference spectra is divided by the same factor x. Here, the (B-Y) ratio=2.25.

All the curves in FIGS. 8(*a*) and 8(*b*) can be fitted by the following expression (Formula 1):

$$CCT_{wr}(\alpha)=Y0+A1e^{BYR/t1}+A2e^{BYR/t2} \quad \text{(Formula 1)}$$

Here, factors Y0, A1, t1, A2, and t2 are dependent on the angle $\alpha$ of the output aperture 5 of the retro-reflector 4. BYR is a ratio between the blue light part and the yellow light part of the spectra of the white light 12 from the phosphor 3.

The above expression (Formula 1) can be used to calculate the colour temperature (CCT) finally obtained after the infinite number of times of retro-reflection at each BYR and each angle $\alpha$. The expression (Formula 1) is derived from the fitting resulting from a simulation. The expression (Formula 1) is useful in that it can estimate the colour temperature of white light that can be obtained when structure parameters (including BYR and $\alpha$) are found.

The horizontal axis represents the blue-yellow ratio (BYR, or blue light ratio), and the vertical axis represents the colour temperature (CCT) when the retro-reflector 4 is provided. FIG. 8(*b*) is a graph having the related portion in FIG. 8(*a*) enlarged.

To obtain the colour temperature (CCT) of BYR=1 for each angle $\alpha$ of the output aperture 5, the spectra of the white light 12 from the standard YAG phosphor 3 with a colour temperature (CCT) of 6500 K are used for reference.

For example, to obtain the emitted light 13 at the angle α of 30 degrees of the output aperture 5 of the retro-reflector 4 and at the colour temperature of 6000 K, the BYR needs to be approximately 2.75, as illustrated in FIG. 8(*a*).

The parameters illustrated in FIG. 8(*c*) are obtained, and the curves illustrated in FIGS. 8(*a*) and 8(*b*) are fitted with the above expression (Formula 1). The BYR is adjusted on the basis of a desired colour temperature (CCT) and the angle α of the output aperture 5 of the retro-reflector 4.

The factors Y0, A1, t1, A2, and t2 in the above expression (Formula 1) are calculated by a simulation of the colour temperature (CCT) finally obtained after the infinite number of times of retro-reflection performed at each BYR and each angle α, and are derived by fitting the simulation results. The above expression (Formula 1) and the factors Y0, A1, t1, A2, and t2 have no physical meanings. The above expression (Formula 1) is a simplified approximate expression obtained by the fittings to express the simulation results with a simple expression.

First, the spectra of the laser pump light 11 and the spectra of the white light 12 are selected. Then, the blue light ratio is changed, and the colour temperature (CCT) at the angle α of 90 degrees (no retro-reflector 4 is provided) is calculated. In the example illustrated in FIG. 6, blue light ratios of 1, 1.1, 1.18, and 1.25 are used. To obtain the colour temperature (CCT) at different angles α of the output aperture 5 of the retro-reflector 4, an analytic expression is derived on the basis of the ratio between the emitted light 13 from the output aperture 5 and the reflected light at a reflection area. This is based on the white light 12 that has been converted eight times after light is incident on the phosphor 3 after successive reflection. It is assumed that the blue absorption ratio is linear, with no reflection loss at the retro-reflector 4 and no re-absorption loss of the white light 12.

This is based on the concept to use the phosphor 3 that originally emits more blueish white light in order to achieve a desired colour temperature of the emitted light 13 from the output aperture 5.

Figure 9:
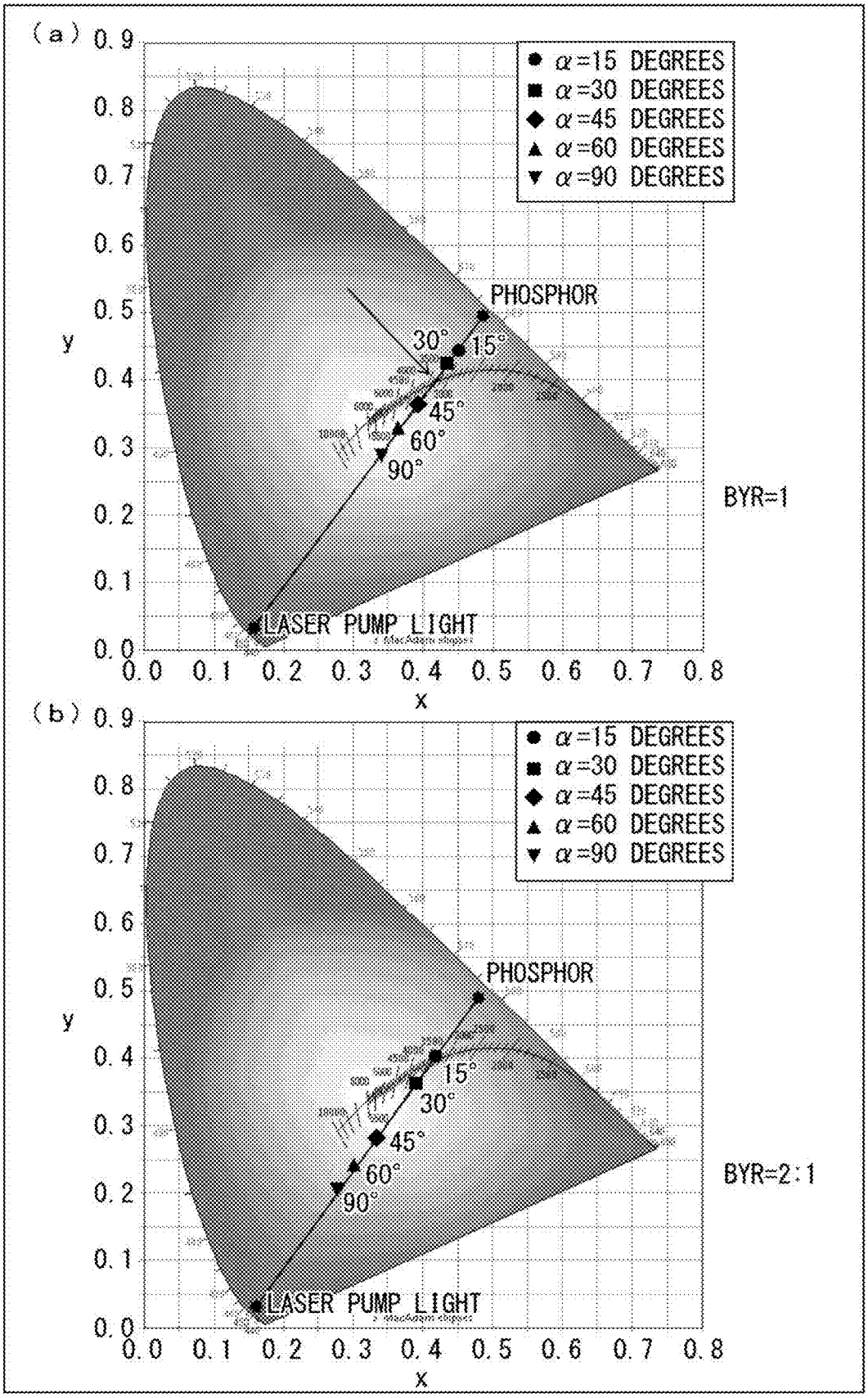
FIG. 9(*a*) is a chromaticity diagram for the emitted light of the light source unit, and FIG. 9(*b*) is a chromaticity diagram for other purposes.

FIG. 9(*a*) is a chromaticity diagram for the emitted light 13 of the light source unit 1, and FIG. 9(*b*) is a chromaticity diagram for other purposes.

FIGS. 9(*a*) and 9(*b*) illustrate an example of how an appropriate colour temperature (CCT) of the emitted light 13 with respect to any angle α of the output aperture 5 of the retro-reflector 4 is obtained by adjusting the ratio of blue light relative to yellow light (BYR). In this example, the laser pump light 11 is emitted from the laser diode of the pump light source 2 at a wavelength of 450 nm, and the dominant wavelength of the phosphor 3 is 575 nm. The phosphor 3 made of different materials give different slopes, that is, different intersection points through the Planckian Locus.

When the chromaticity of white light is plotted on the Planckian locus (blackbody locus), the white light can be regarded as natural light in the nature (such as light from charcoal, a candle flame, or light from an incandescent lamp). By controlling the chromaticity of this white light to be proximate to the blackbody locus, the white light further approximates to natural illumination, which is technically significant and economically valuable.

By changing the BYR from 1 to 2:1, as illustrated in FIGS. 9(*a*) and 9(*b*), the range of the angle α (for example, 15 degrees to 90 degrees) representing a usable size of the output aperture 5 shifts downward along the phosphor-laser pump light line, as illustrated in FIGS. 9(*a*) and 9(*b*), so that capturing of a desired colour temperature (CCT) at the angle α of the selected output aperture 5 is allowed. For example, when the BYR is 1, as illustrated in FIG. 9(*a*), light from the output aperture 5 of the retro-reflector 4 at the angle α of 15 degrees cannot operate immediately above the Planckian locus. However, when the BYR is increased to 2:1, as illustrated in FIG. 9(*b*), the range of the angle α of the output aperture 5 shifts downward, so that light from the output aperture 5 at the angle α of 15 degrees can operate immediately above the Planckian locus. This method of increasing the BYR is also effective for light having the colour temperature (CCT) not exactly on the Planckian locus.

Modification Example

Figure 10:
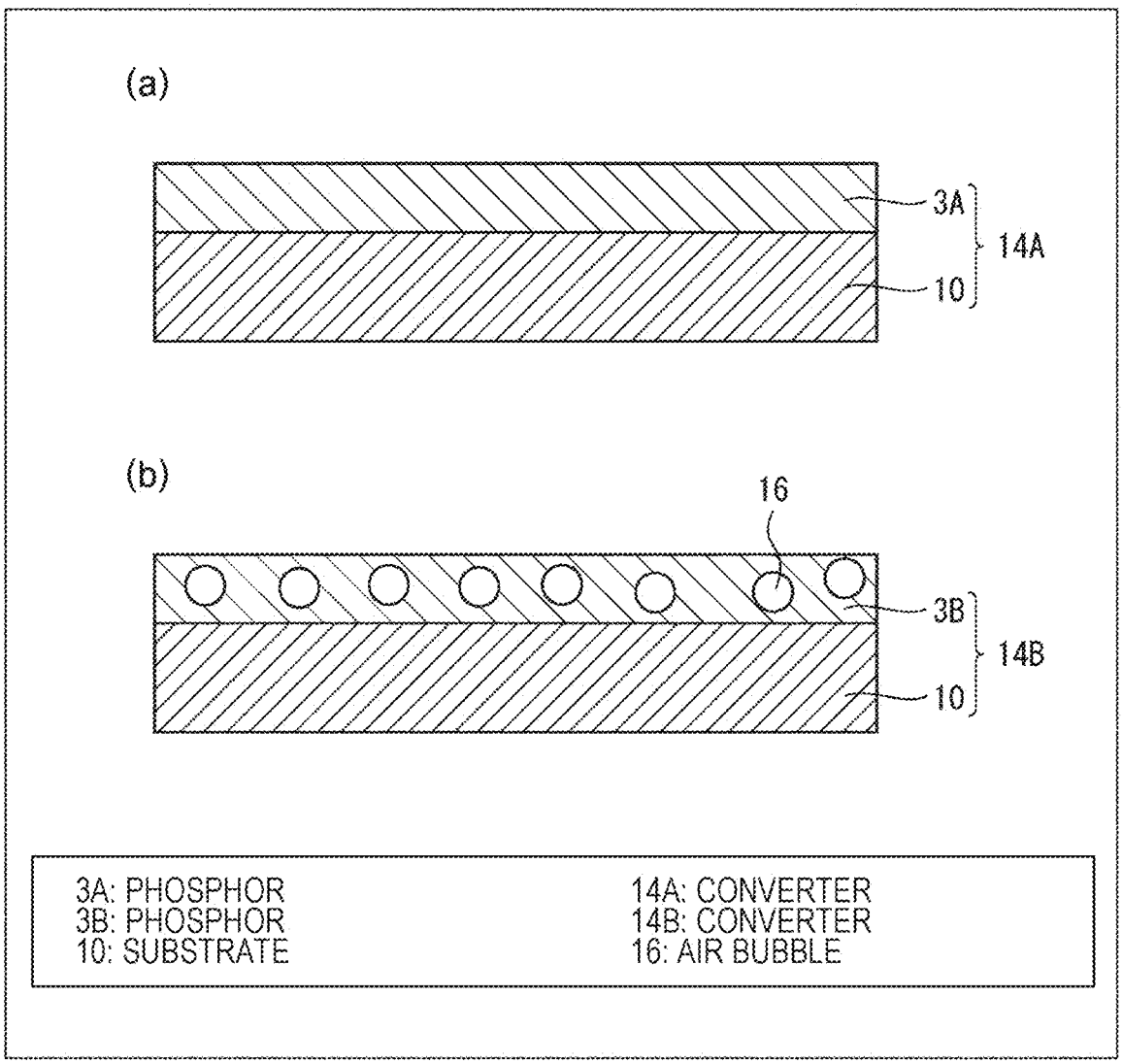
FIG. 10(*a*) is a cross-sectional view of the converter according to another modification example disposed on the light source unit, and FIG. 10(*b*) is a cross-sectional view of the converter according to another modification example disposed on the light source unit.

FIG. 10(*a*) is a cross-sectional view of a converter according to a modification example included in the light source unit 1, and FIG. 10(*b*) is a cross-sectional view of another converter according to a modification example included in the light source unit 1. For convenience of illustration, components having the same functions as those described in any of the above embodiments are denoted with the same reference signs without being described repeatedly.

A converter 14A includes a substrate 10 and a phosphor 3A. The phosphor 3A has its particle density adjusted in accordance with the angle α of the output aperture 5 of the retro-reflector 4. The particle density of the phosphor 3A is adjusted to reduce blue light absorption to thus increase the colour temperature (CCT).

Reduction of the particle density of the phosphor 3A increases the ratio of a binder material of the phosphor 3A. This ratio has some variations.

For a pump light source of the present embodiment used in automotive applications, the colour of emitted light is preferably white and with a colour temperature of around 6000 K. An optimized ratio for the colour temperature (CCT)=6000 K without the retro-reflector 4 is YAG (Ce (Ce=0.7 mol %, d50=8 um)):$SiO_2$ binder=80%:20%.

If the retro-reflector 4 with an output aperture 5 of α=30 degrees is added, the colour temperature (CCT) shifts to 4250 K according to calculations.

When the ratio of the phosphor 3A to the binder material are adjusted to these values YAG (Ce (Ce=0.7 mol, d50=8 um)):$SiO_2$ binder=65%:35*, it would be possible to achieve a colour temperature (CCT) of 6000 K at the output aperture 5 of angle α=30 degrees.

Another way to achieve the target colour temperature (CCT) would be to reduce the density of Ce, which is the emission center of the phosphor 3A, to these values YAG (Ce (Ce=0.4 mol %, d50=8 um)):$SiO_2$ binder=80%:20%.

Another way would be to reduce the particle size of the phosphor 3A to these values YAG (Ce (Ce=0.7 mol %, d50=2 um):$SiO_2$ binder=80%:20%.

For the phosphor 3A, a phosphor material that emits light with a shorter wavelength, such as GAL, than that of a standard YAG material may be used. This may lower the conversion efficiency of the phosphor 3A, but this should not be a big problem, because the blue light will be recycled with the retro-reflector 4, and so increase the probability of being absorbed by the phosphor 3A.

A nanophosphor adjusted to emit light at a desired colour temperature may be used. Nanophosphors are typically particles with the diameter of 100 nm or smaller. Their properties of emission depend on the material and the particle size.

A converter 14B includes a substrate 10 and a phosphor 3B. The phosphor 3B includes air bubbles 16, as illustrated in FIG. 10(*b*). In a portion including air bubbles, that is, air gaps, the blue laser beam is merely scattered without being absorbed nor subjected to color conversion. Thus, the white light emitted from the converter 14B has a blueish white color.

Embodiment 2

Another embodiment of the present invention will be described, below. For convenience of illustration, components having the same functions as those described in any of the above embodiments are denoted with the same reference signs without being described repeatedly.

Figure 11:
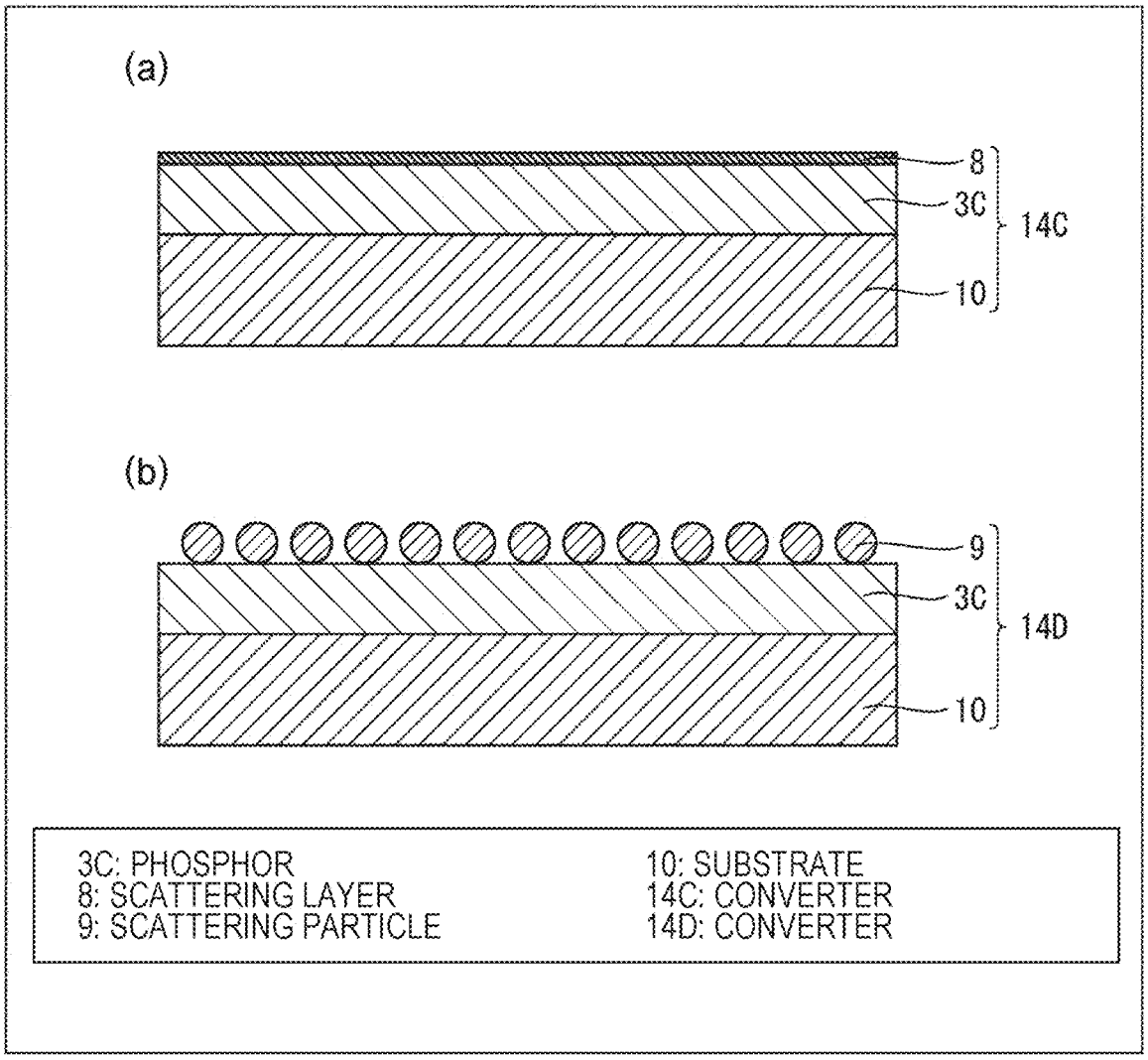
FIG. 11(*a*) is a cross-sectional view of a converter included in the light source unit according to Embodiment 2, and FIG. 11(*b*) is a cross-sectional view of the converter according to another modification example disposed on the light source unit.

FIG. 11(*a*) is a cross-sectional view of a converter included in a light source unit according to embodiment 2, and FIG. 11(*b*) is a cross-sectional view of a converter according to another modification example included in the light source unit.

As illustrated in FIG. 11(*a*), a converter 14C includes a substrate 10, a phosphor 3C disposed on the substrate 10, and a scattering layer 8 disposed on the phosphor 3C. The scattering layer 8 scatters the laser pump light 11 emitted from the pump light source 2.

The phosphor 3C is made of a standard phosphor conversion material containing YAG particles and a binder material. The scattering layer 8 transmits 100% of yellow light. The scattering layer 8 transmits part of, that is, 90% of blue light of the wavelength of 450 nm, and scatters 10% of the blue light. Thus, most part of the blue light is transmitted to the phosphor 3C through the scattering layer 8, and converted into yellow light by the phosphor 3C. The ratio of blue light transmitted through the scattering layer 8 and blue light scattered by the scattering layer 8 can be changed to adjust the colour temperature of the blue light. The scattering layer 8 can be made of a dielectric multilayer (DBR) made of $TiO_2$ and $SiO_2$ on a rough surface.

As illustrated in FIG. 11(*b*), a converter 14D includes a substrate 10, a phosphor 3C disposed on the substrate 10, and scattering particles 9 disposed on the phosphor 3C. The scattering particles 9 scatter the laser pump light 11 emitted from the pump light source 2.

The scattering particles 9 are formed from fine particles such as polystyrene, $TiO_2$, or $Al_2O_3$, or nanoparticles, which do not absorb light in the visible wavelength range. The scattering particles 9 are spherical to avoid polarization dependence. If polarization dependence is desired, non spherical nanoparticles are used for the scattering particles 9. The dimension of nanoparticles forming the scattering particles 9 should be similar to the wavelength (450 nm) of the laser pump light 11. Increasing the dimension of nanoparticles will shift the scattering peak wavelength toward the red, and decreasing the dimension of nanoparticles will shift the scattering peak wavelength toward the violet.

The scattering layer 8 and the scattering particles 9 may be combined to form a converter.

Embodiment 3

Figure 12:
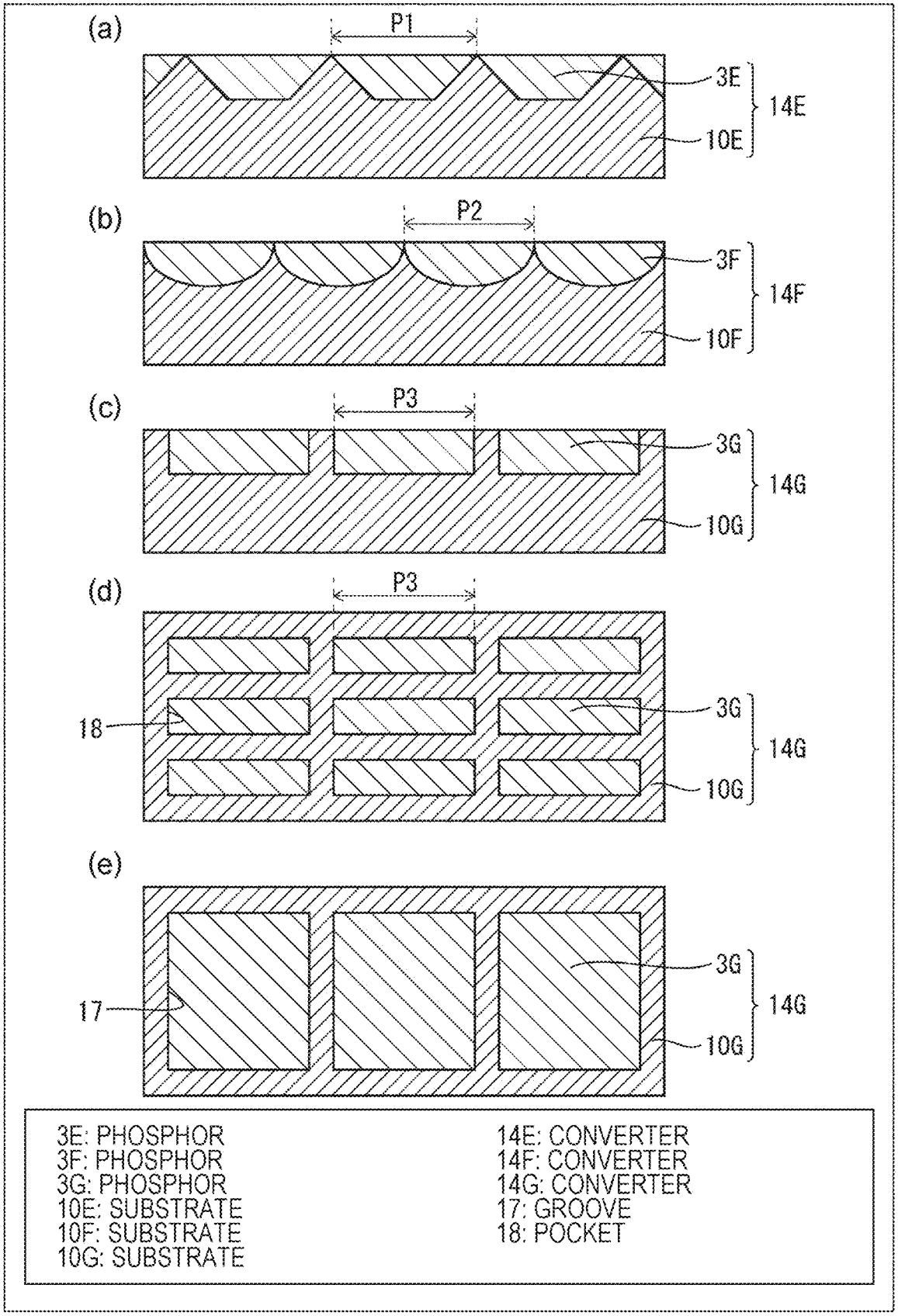
FIG. 12(*a*) is a cross-sectional view of a converter included in a light source unit according to Embodiment 3, FIG. 12(*b*) is a cross-sectional view of the converter according to another modification example disposed on the light source unit, FIG. 12(*c*) is a cross-sectional view of the converter according to another modification example included in the light source unit, FIG. 12(*d*) is a plan view of the converter according to another modification example, and FIG. 12(*e*) is a plan view of another modification example.

FIG. 12(*a*) is a cross-sectional view of a converter included in a light source unit according to Embodiment 3, FIG. 12(*b*) is a cross-sectional view of a converter according to a modification example included in the light source unit, FIG. 12(*c*) is a cross-sectional view of another converter according to a modification example included in the light source unit, FIG. 12(*d*) is a plan view of the converter according to another modification example, and FIG. 12(*e*) is a plan view of the converter according to another modification example. For convenience of illustration, components having the same functions as those described in any of the above embodiments are denoted with the same reference signs without being described repeatedly.

In Embodiment 3, geometric pattern combinations between any of substrates 10E, 10F, and 10G and any of phosphors 3E, 3F, and 3G form blue-light-ratio increasing members that increase the blue light ratio of the white light 12 converted by the phosphors 3E, 3F, and 3G.

As illustrated in FIG. 12(*a*), a converter 14E includes the substrate 10E and the phosphor 3E. In the substrate 10E, the thickness of the phosphor 3E changes along the surface of substrate 10E to reduce the blue light absorption of the phosphor 3E. The blue light absorption is proportional to the thickness of the phosphor 3E. Thus, reduction of the thickness of the phosphor 3E reduces the blue light absorption. A typical thickness of the phosphor 3E disposed on a flat substrate is approximately greater than or equal to 10 μm and smaller than or equal to 100 μm, or preferably, greater than or equal to 10 μm and smaller than or equal to 50 μm. The substrate 10E has a cross section including multiple triangular portions on the side facing the phosphor 3E. A gap P1 between the multiple triangular portions is greater than or equal to 20 μm and smaller than or equal to 30 μm.

As illustrated in FIG. 12(*b*), a converter 14F includes the substrate 10F and the phosphor 3F. In the substrate 10F, the thickness of the phosphor 3F changes along the surface of substrate 10F to reduce the blue light absorption of the phosphor 3F. The blue light absorption is proportional to the thickness of the phosphor 3F. Thus, the reduction of the thickness of the phosphor 3F reduces the blue light absorption. The substrate 10F has a cross section including multiple curved portions on the side facing the phosphor 3F. A dimension P2 of each of the curved portions is greater than or equal to 20 μm and smaller than or equal to 30 μm.

The triangular portions and the curved portions may be combined to form a substrate.

As illustrated in FIGS. 12(*c*), 12(*d*), and 12(*e*), a converter 14G includes the substrate 10G and the phosphor 3G. The substrate 10G is formed so that not all the surface is covered with the phosphor 3G. The substrate 10G has grooves, as illustrated in FIG. 12(*e*), or pockets 18, as illustrated in FIG. 12(*d*), formed in its surface. The phosphor 3G is disposed in these grooves 17 or pockets 18. The dimension P3 of these grooves 17 or pockets 18 is typically greater than 20 μm. Preferably, the dimension P3 is greater than or equal to 20 μm and smaller than or equal to 30 μm.

Preferably, the substrate 10G has an exposed portion devised to diffusively reflect the laser pump light 11 when the laser pump light 11 hits the surface of the substrate 10G. Specifically, the surface of the substrate 10G diffusively reflects the blue light and the white light 12. The substrate 10G can obtain properties of diffusively reflecting the blue light and the white light 12 by selecting the substrate 10G that has a surface having diffusive reflective properties suitable for these types of light or by depositing a coating having similar diffusive reflective properties on the substrate 10G.

Geometric patterns different from the patterns illustrated in FIG. 12(*a*) to 12 (*e*) can be used.

Thermal properties of the phosphors 3E, 3F, and 3G can also be improved in this way because the phosphors 3E, 3F, and 3G have larger areas that are in contact with the substrates 10E, 10F, and 10G. Preferably, the substrates 10E, 10F, and 10G are made of a metal with high thermal conductivity such as aluminium or copper but can also be made of other material such as an aluminum oxide. The use of the substrates 10E, 10F, and 10G of such geometric patterns may be thought to reduce the color mixing if the phosphors 3E, 3F, and 3G are used without a retro-reflector 4. However, this problem is solved by the retro-reflector 4 that recycles the white light 12 and so increases the color mixing by increasing the number of reflection inside of the retro-reflector 4.

Embodiment 4

Figure 13:
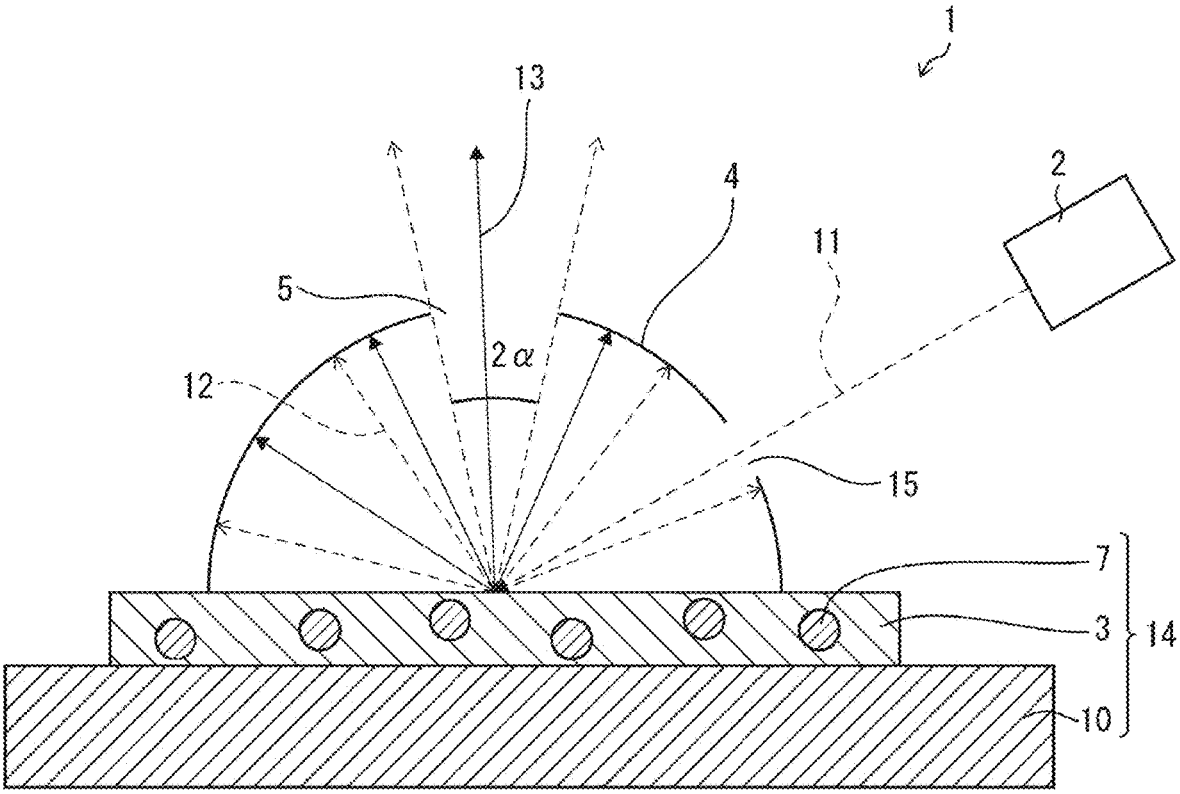
FIG. 13 is a schematic cross-sectional view of a light source unit according to Embodiment 4.

FIG. 13 is a schematic cross-sectional view of a light source unit 1 according to Embodiment 4, and corresponds to a combination of FIG. 1 and FIG. 2 for Embodiment 1.

The laser pump light 11 emitted from the semiconductor laser diode of the pump light source 2 and focused via a lens system is incident on the phosphor 3 in a spot size of 0.5 mm diameter. Part of the white light 12 resulting from wavelength conversion is reflected by the retro-reflector 4 back to the phosphor 3 as retro-reflection light, while another part is scattered by the phosphor 3. The emitted light 13, which is another part of the white light 12, is emitted through the output aperture 5 of the angle 2α. The colour temperature (CCT) of the emitted light 13 can be changed by changing the angle α of the output aperture 5 or by changing the colour temperature of the white light 12 emitted by the phosphor 3. A small angle α is usually desirable to result in a pump light source 2 with a small etendue. For a fixed small angle α (for example, 30 degrees), the colour temperature of the emitted light 13 emitted through the output aperture 5 can be adjusted by changing the colour temperature of the white light 12 emitted by the phosphor 3.

The retro-reflector 4 includes an output aperture 5 of the angle 2α and a coupling aperture 15 for a laser pump light 11. Preferably, the retro-reflector 4 is a half sphere having the coupling aperture 15 with a diameter larger than the diameter of the laser pump light 11 when the laser pump light 11 hits the phosphor 3. The retro-reflector 4 can be made of a hollow structure with a highly reflective internal surface. The structure of the retro-reflector 4 could be made of a metal, a plastic, or any material that can function in such a way. The retro-reflector 4 can also be made of a transparent solid half sphere such as glass, BK7, or any other material that are transparent to visible light. The outer peripheral surface of the transparent half sphere is then coated with a reflective layer that could be made of aluminium, titanium, palladium, nickel, or any other material that has a high reflectivity. When the retro-reflector 4 is a metal shell retro-reflector, the inner wall of the half sphere is coated with a highly reflective material. When the retro-reflector 4 is a retro-reflector made of a transparent member such as glass, the outer wall of the half sphere is coated with a highly reflective material.

The retro-reflector 4 can be mounted in contact with the phosphor 3 using a non light absorbing layer. This non light absorbing layer may have high thermal conductivity. There may also be a gap between the phosphor 3 and the end surface of the retro-reflector 4 facing the phosphor 3.

The coupling aperture 15 may have any shape. The coupling aperture 15 needs to have a size larger than the size of the laser pump light 11 to prevent the laser pump light 11 from being blocked. Typically, the coupling aperture 15 has a size smaller than the size of the output aperture 5 to reduce the loss of light that could escape out of the coupling aperture 15. If the coupling aperture 15 is too large, it will also affect the colour temperature of the emitted light 13 emitted through the output aperture 5, which is not desirable.

The laser pump light 11 is preferably incident on the coupling aperture 15 of the retro-reflector 4 so that it hits the surface of the phosphor 3 at the center of the retro-reflector 4. In the case where the retro-reflector 4 has a half sphere structure, the laser pump light 11 hits the surface of the phosphor 3 at the center of the retro-reflector 4.

The output aperture 5 is most preferably circular. In the case where the retro-reflector 4 has a hollow structure, the coupling aperture 15 and the output aperture 5 are formed by forming holes in the structure. In the case where the retro-reflector 4 has a solid structure such as glass, the coupling aperture 15 and the output aperture 5 are formed by not coating the area of the coupling aperture 15 and the output aperture 5 by a reflective layer so that the area is transparent to visible light.

This changing in the colour temperature of the white light 12 from the phosphor 3 can be obtained by adding the scattering particles 7 in the phosphor 3 with the following characteristic: adding the scattering particles 7 within the phosphor 3 to decrease the phosphor density and increase scattering of the laser beam. These scattering particles 7 could be of different materials, such as $Al_2O_3$, diamond, or $TiO_2$. A typical diameter of the scattering particles 7 is around 500 μm to 600 μm. The scattering particles 7 preferably have very low absorption of the light in the visible range. The scattering particles 7 could be made of high thermal conductivity materials to improve the thermal properties of the phosphor 3.

If the scattering particles 7 are used alone without a retro-reflector, it is usually a problem because they will decrease the light emitting efficiency of the phosphor 3, increase the emission area of the phosphor 3 due to scattering of light at the scattering particles 7, and fail to obtain an appropriate colour temperature. However, when the retro-reflector 4 and the scattering particles 7 are used in combination, these problems can be partially or completely suppressed. Thanks to the retro-reflector 4 recycling the white light 12, the color homogeneity will be improved, so that white light with an appropriate colour temperature can be obtained. Using the retro-reflector 4 having the output aperture 5 with a small angle α will decrease the emission angle of the white light, which is advantageous.

Figure 14:
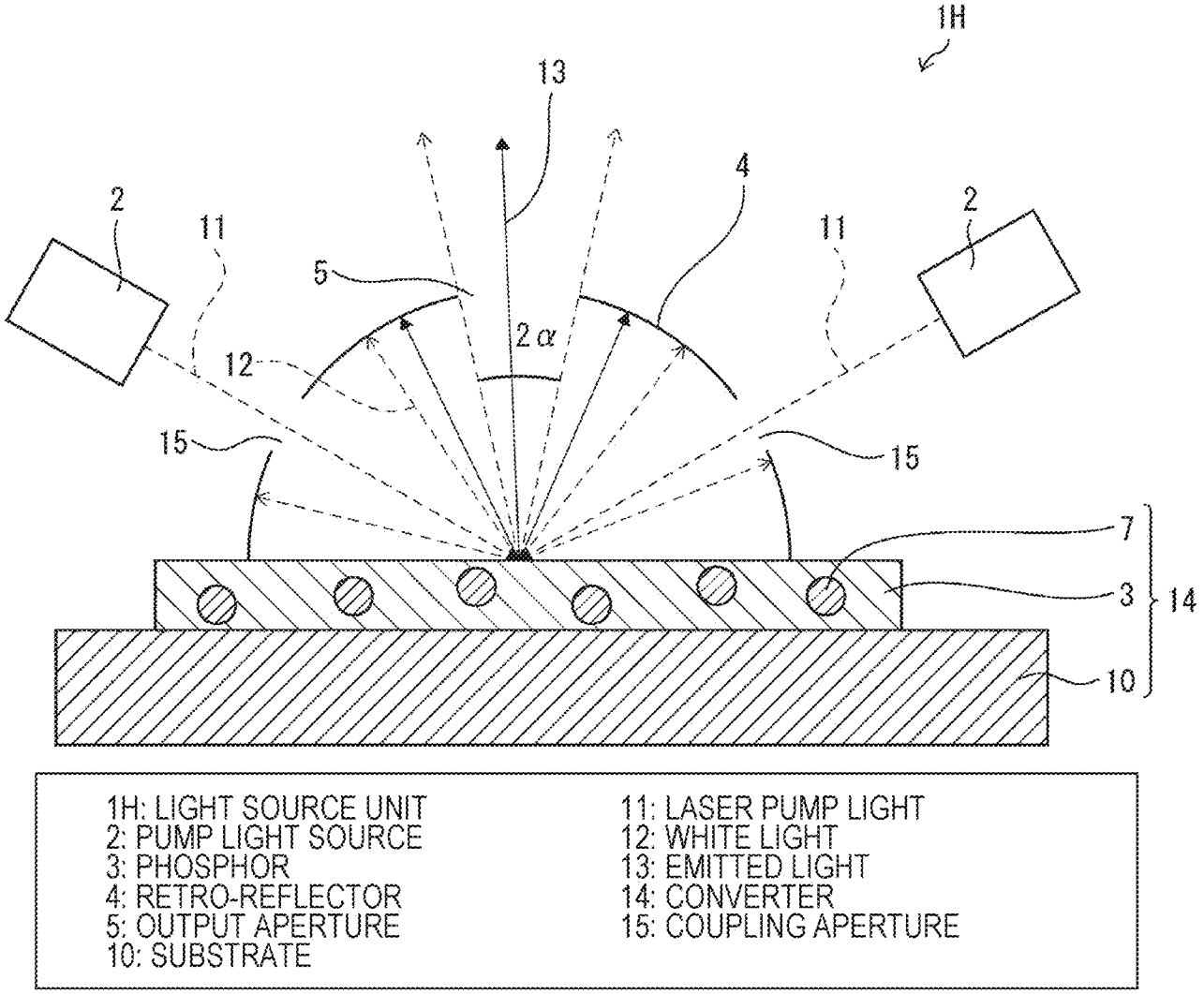
FIG. 14 is a schematic cross-sectional view of a light source unit according to a modification example.

FIG. 14 is a schematic cross-sectional view of a light source unit 1H according to a modification example of Embodiment 4. For convenience of illustration, components having the same functions as those described in any of the above embodiments are denoted with the same reference signs without being described repeatedly.

The light source unit 1H differs from the light source unit 1 described above with FIG. 13 in that it has two coupling apertures 15 in the retro-reflector 4, and two pump light sources 2. Two beams of the laser pump light 11 emitted from the two pump light sources 2 pass through the respective two coupling apertures 15 formed in the retro-reflector 4, and are incident on the same position on the surface of the phosphor 3. In this example, two beams of the laser pump light 11 preferably have the same wavelength of 450 nm.

Instead of the two pump light sources 2, three or more pump light sources may be provided.

Figure 15:
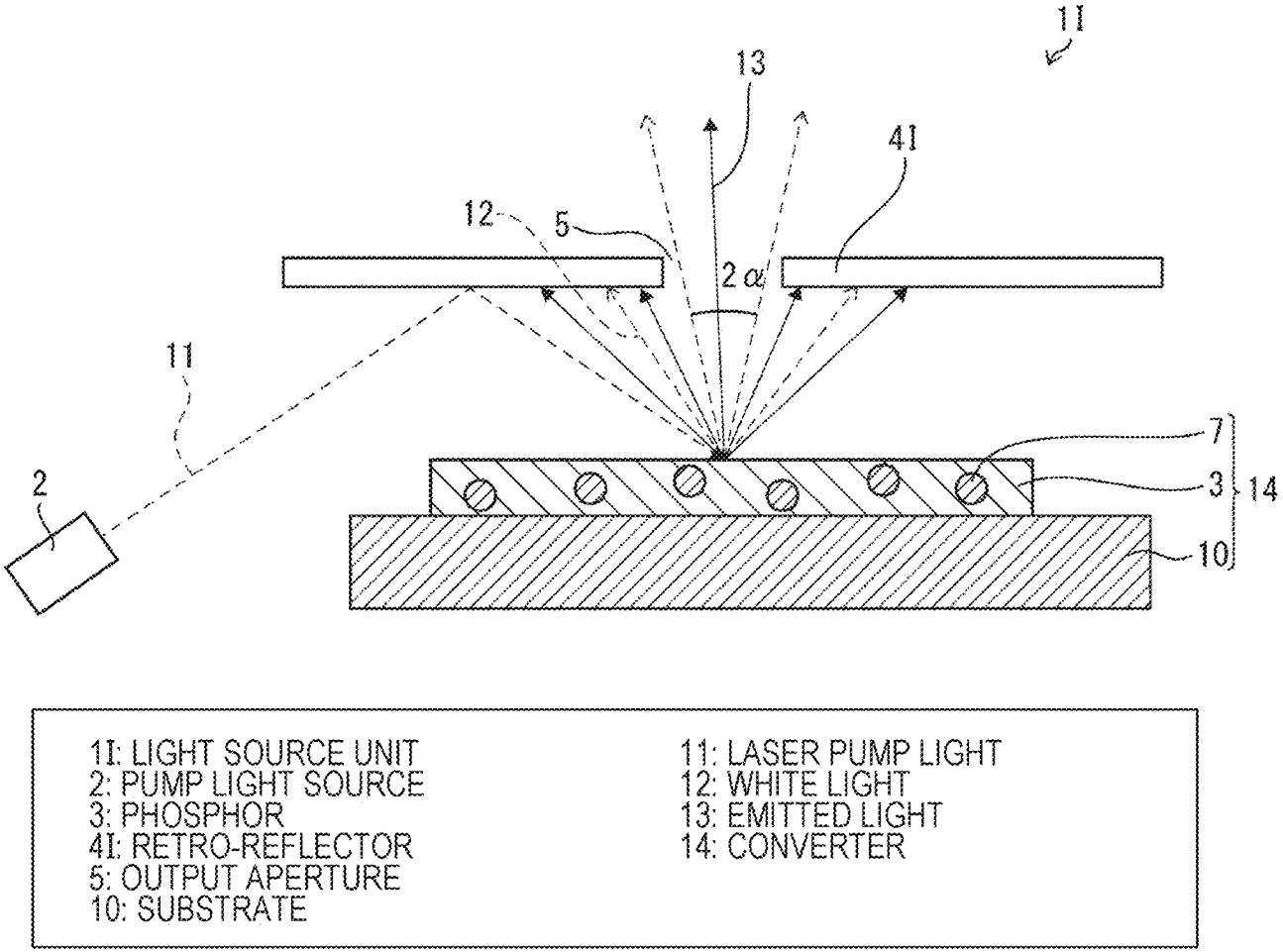
FIG. 15 is a schematic cross-sectional view of a light source unit according to another modification example.

FIG. 15 is a schematic cross-sectional view of a light source unit 1I according to another modification example of Embodiment 4.

The light source unit 1I differs from the light source unit 1 described above with FIG. 13 in that it includes a flat film-shaped retro-reflector 4I. The retro-reflector 4I has a nanophotonic structure that reflects the white light 12 from the phosphor 3 back to the phosphor 3 as retro-reflection light, which has the same functions as the dome-shaped retro-reflector 4 illustrated in FIG. 13. The laser pump light 11 emitted from the pump light source 2 is reflected off the surface of the nanophotonic structure of the retro-reflector 4I facing the substrate 10, and incident on the phosphor 3. Instead, another retro-reflector having a different structure may be used.

Figure 16:
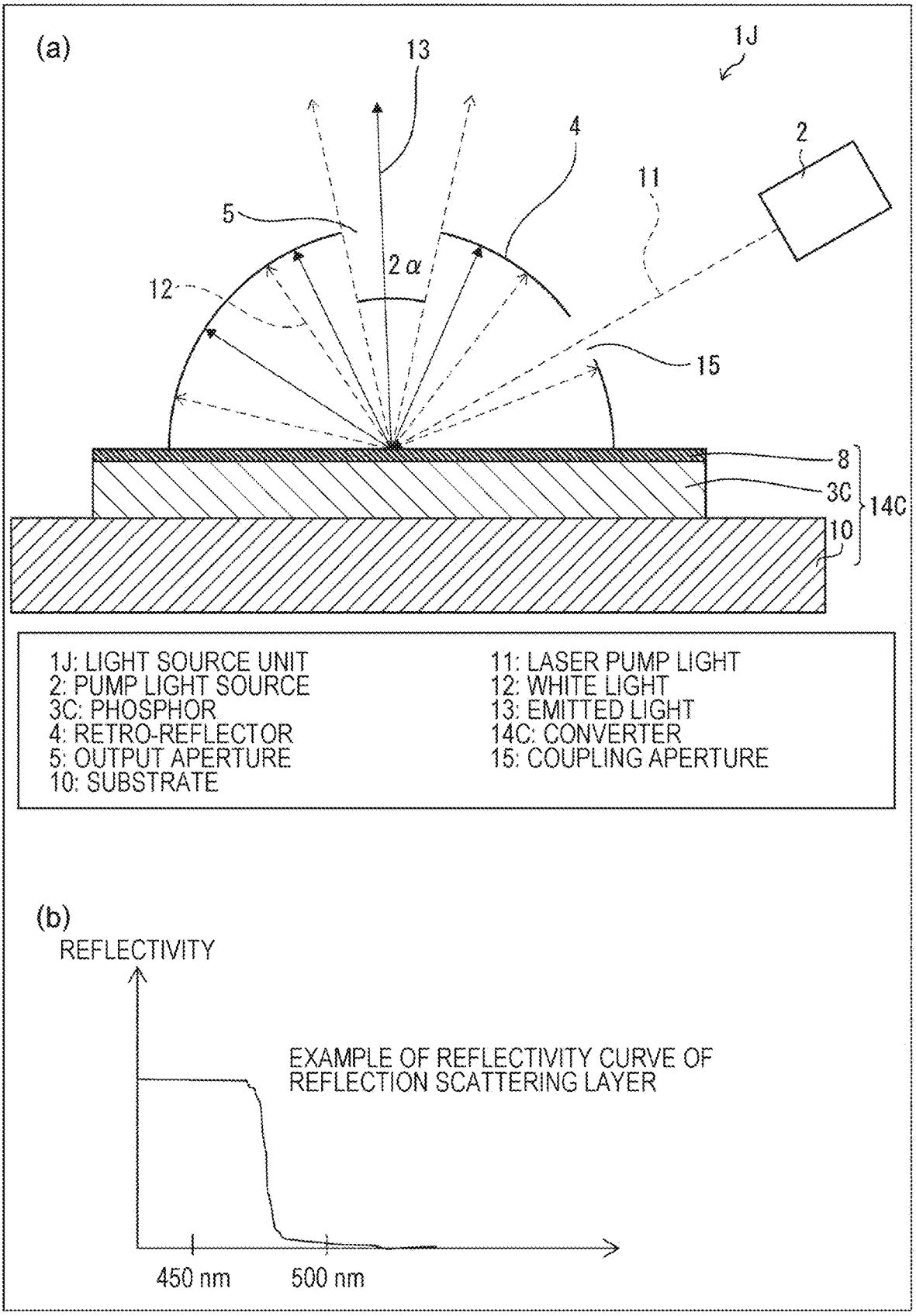
FIG. 16(*a*) is a schematic cross-sectional view of a light source unit according to another modification example, and FIG. 16(*b*) is a graph of a reflectivity curve of a scattering layer disposed in the modification example.

FIG. 16(*a*) is a schematic cross-sectional view of a light source unit 1J according to another modification example of Embodiment 4, and FIG. 16(*b*) is a graph of a diffusion reflectivity curve of a scattering layer 8 disposed in the modification example. The light source unit 1J illustrated in FIG. 16(*a*) corresponds to a combination of FIG. 1 for Embodiment 1 and FIG. 11(*b*) for Embodiment 2. For convenience of illustration, components having the same functions as those described in any of the above embodiments are denoted with the same reference signs without being described repeatedly.

This changing in the colour temperature of the white light 12 from the phosphor 3C is obtained by adding the scattering layer 8 with the following characteristics on the upper surface of the phosphor 3C.

The scattering layer 8 transmits 100% of the green to yellow light, or light having a wavelength above 500 nm. The scattering layer 8 transmits part of (80% or less) blue light of a wavelength of 450 nm of the laser pump light 11, and partially diffusively reflects or scatters another part of (20% or more) blue light. Specifically, the scattering layer 8 transmits most part of the blue light. The phosphor 3C absorbs part of the blue light that has been transmitted through the scattering layer 8, and the part of the blue light is subjected to wavelength conversion to be formed into yellow light. By changing the ratio of the diffusively reflected or scattered blue light with the scattering layer 8, the colour temperature of the white light 12 from the phosphor 3 can also be changed.

The scattering layer 8 could be made of a multi-layer structure of $SiO_2/TiO_2$ layers or any dielectric layers that are arranged to make an interference filter with such properties.

Figure 17:
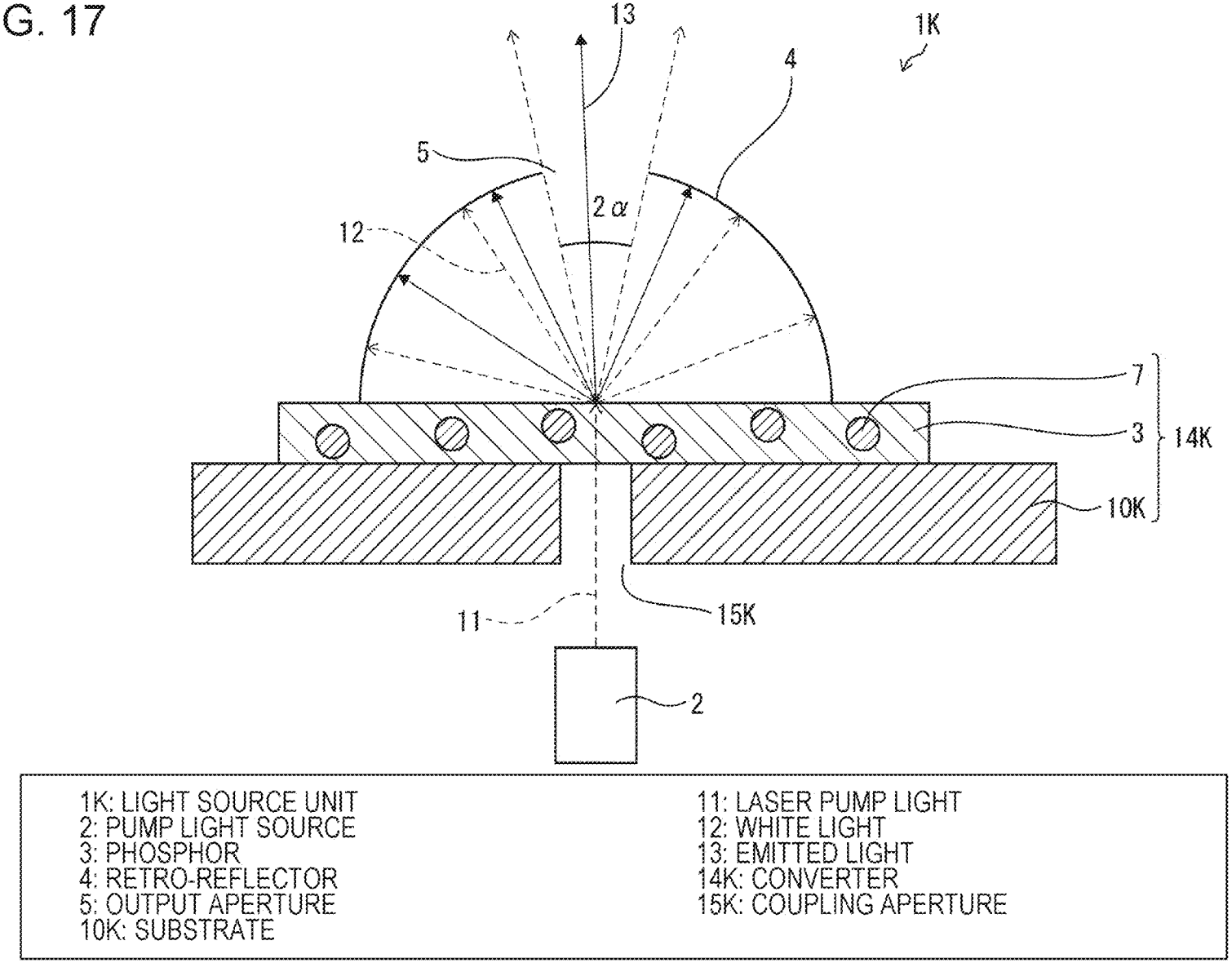
FIG. 17 is a schematic cross-sectional view of a light source unit according to another modification example.

FIG. 17 is a schematic cross-sectional view of a light source unit 1K according to another modification example of Embodiment 4. For convenience of illustration, components having the same functions as those described in any of the above embodiments are denoted with the same reference signs without being described repeatedly.

This modification example differs from the light source unit 1 described above in FIG. 13 in that the light source unit 1K includes a pump light source 2 disposed opposite to the phosphor 3 with respect to a substrate 10K. The laser pump light 11 emitted from the pump light source 2 passes through a coupling aperture 15K formed in the substrate 10K, is incident on the phosphor 3, and is transmitted through the phosphor 3 to be converted into the white light 12.

[Summarization]

Any of light source units 1 and 1H to 1K according to a first aspect of the present invention includes a pump light source 2 that emits a laser beam (laser pump light 11); a phosphor 3 that converts the laser beam (laser pump light 11) emitted from the pump light source 2 into converted light (white light 12), and a retro-reflector 4 or 41 that has an output aperture 5, which allows emission of part of the converted light (white light 12) converted by the phosphor 3 as emitted light 13, the retro-reflector 4 or 41 reflecting another part of the converted light (white light 12) back to the phosphor 3. The phosphor 3 includes a blue-light-ratio increasing member (scattering particles 7, a scattering layer 8, or scattering particles 9), which increases the blue light ratio of the converted light (white light 12).

In the above structure, the phosphor reflects part of the retro-reflection light returned from the retro-reflector toward the output aperture to add the part of the retro-reflection light to the emitted light. With the addition of the part of the retro-reflection light, the blue light ratio of the converted light converted by the phosphor increases on the basis of a desired colour temperature of the emitted light emitted through the output aperture and the dimension of the output aperture. Thus, a phenomenon of decreasing the white colour temperature of emitted light emitted through the output aperture due to the addition of part of the retro-reflection light can be partially or completely suppressed. Thus, a light source unit capable of emitting preferable white light can be achieved.

In a light source unit 1, 1H, 1I, or 1K according to a second aspect of the present invention having the structure according to the first aspect, the blue-light-ratio increasing member may be scattering particles 7 included in the light converter layer (converter 14) to scatter the laser beam (laser pump light 11) emitted from the pump light source 2.

In the above structure, the scattering particles scatter blue light of the laser beam. Thus, the blue light absorption of the phosphor can be partially or completely suppressed. The blue light ratio of the converted light converted by the phosphor is thus increased.

In a light source unit 1, 1H, 1I, or 1K according to a third embodiment of the present invention and having the structure according to the above aspect 1, the scattering particles 7 may be formed from a high thermal conductivity material to improve the thermal properties of the phosphor 3.

In the above structure, the blue light absorption of the phosphor is further suppressed.

In a light source unit 1 according to a fourth aspect of the present invention and having the structure according to the first aspect, the blue-light-ratio increasing member may be the phosphor 3A having a particle density adjusted in accordance with a size of the output aperture 5 of the retro-reflector 4.

In the above structure, the particle density of the phosphor is adjusted in accordance with the size of the output aperture of the retro-reflector. Thus, the blue light absorption of the phosphor can be partially or completely suppressed, so that the blue light ratio of the converted light converted by the phosphor increases.

In a light source unit 1J according to a fifth aspect of the present invention having the structure according to the first aspect, the blue-light-ratio increasing member may be a scattering layer 8 disposed on a surface of the phosphor 3 facing the pump light source 2 to diffusely reflect or scatter the laser beam (laser pump light 11) emitted from the pump light source 2.

In the above structure, a laser beam emitted from a pump light source is reflected or scattered by a scattering layer. Thus, the blue light absorption of the phosphor can be partially or completely suppressed, so that the blue light ratio of the converted light converted by the phosphor increases.

In a light source unit 1 according to a sixth aspect of the present invention and having the structure according to the first aspect, the blue-light-ratio increasing member may be scattering particles 9 disposed on a surface of the phosphor 3 facing the pump light source 2 to diffusely reflect or scatter the laser beam (laser pump light 11) emitted from the pump light source 2.

In the above structure, a laser beam emitted from the pump light source is diffusedly reflected or scattered by the scattering particles disposed on the surface of the phosphor facing the pump light source. Thus, the blue light absorption of the phosphor can be partially or completely suppressed, so that the blue light ratio of the converted light converted by the phosphor increases.

A light source unit 1 according to a seventh aspect of the present invention and having the structure according to the first aspect may further include substrates 10E, 10F, and 10G that support the phosphors 3E, 3F, and 3G, and in which the blue-light-ratio increasing member may be constituted of a combination of geometric patterns of the substrates 10E, 10F, and 10G and the phosphors 3E, 3F, and 3G.

In the above structure, the substrates and the phosphors are combined into geometric patterns. Thus, the blue light absorption of the phosphor can be partially or completely suppressed, so that the blue light ratio of the converted light converted by the phosphor increases.

In any of the light source units 1 and 1H to 1K according to an eighth aspect of the present invention and having the structure according to the first aspect, a desired colour temperature of the emitted light 13 may be larger than or equal to 2000 K and smaller than or equal to 10000 K.

In the above structure, the blue light ratio of the converted light converted by the phosphor can be increased on the basis of the size of the output aperture of the retro-reflector.

In any of the light source units 1 and 1H to 1K according to a ninth aspect of the present invention and having the structure according to the first aspect, the retro-reflector may have a hollow dome shape or a flat plate shape.

In the above structure, the retro-reflector can reflect another part of the converted light back to the phosphor as retro-reflection light.

In any of the light source units 1 and 1H to 1K according to a tenth aspect of the present invention and having the structure according to the first aspect, the retro-reflector 4 or 41 may be coupled to the phosphor 3 directly or via an intermediate layer.

In the above structure, the retro-reflector and the phosphor can have a simple structure.

In any of the light source units 1 and 1H to 1K according to an eleventh aspect of the present invention and having the structure according to the first aspect, the blue light ratio increased by the blue-light-ratio increasing member may be determined by the following formula 1 relating to the desired colour temperature and the size of the output aperture: $CCT_{wr}(\alpha)=Y0+A1e^{BYR/t1}+A2e^{BYR/t2}$ . . . (Formula 1), in which the factors Y0, A1, t1, A2, and t2 may be dependent on the angle $\alpha$ representing the size of the output aperture of the retro-reflector, and the BYR may be a ratio between the blue light part and the yellow light part of the spectra of the converted light from the phosphor.

In the above structure, the blue light ratio can be easily determined based on the desired colour temperature and the size of the output aperture.

A light source unit 1H according to a twelfth aspect of the present invention and having the structure according to the first aspect may further include a different pump light source 2 that emits a different laser beam (laser pump light 11), and in which the phosphor 3 may convert the laser beam (laser pump light 11) emitted from the pump light source 2 and the different laser beam (laser pump light 11) emitted from the different pump light source 2 into the emitted light (white light 12).

In the above structure, a light source unit capable of emitting preferable white light with high intensity can be achieved.

The present invention is not limited to the above-described embodiments, and may be changed in various manners within the scope of claims, and the embodiments obtained by appropriately combining technical devices disclosed in any two or more different embodiments are also included in the technical scope of the present invention. Moreover, new technical features can be formed by combining the technical devices described in the embodiments.

REFERENCE SIGNS LIST

1 light source unit
2 pump light source
3 phosphor
4 retro-reflector
5 output aperture
7 scattering particle (blue-light-ratio increasing member)
8 scattering layer (blue-light-ratio increasing member)
9 scattering particle (blue-light-ratio increasing member)
10 substrate
11 laser pump light (laser beam)
12 white light (converted light, retro-reflection light)
13 emitted light
14 converter
15 coupling aperture

The invention claimed is:

1. A light source unit, comprising:
a pump light source that emits a laser beam;
a phosphor that converts the laser beam emitted from the pump light source into converted light; and
a retro-reflector that has an output aperture, which allows emission of part of the converted light converted by the phosphor as emitted light, the retro-reflector reflecting another part of the converted light back to the phosphor as retro-reflection light,
wherein the phosphor includes a blue-light-ratio increasing member, which increases a blue light ratio of the converted light, and
the blue-light-ratio increasing member is the phosphor having a particle density adjusted in accordance with a size of the output aperture of the retro-reflector.

2. The light source unit according to claim 1,
wherein a colour temperature of the emitted light is greater than or equal to 2000 K and smaller than or equal to 10000 K.

3. The light source unit according to claim 1,
wherein the retro-reflector has a hollow dome shape or a flat plate shape.

4. The light source unit according to claim 1,
wherein the retro-reflector is coupled to the phosphor directly or via an intermediate layer.

5. A light source unit, comprising:
a pump light source that emits a laser beam;
a phosphor that converts the laser beam emitted from the pump light source into converted light; and
a retro-reflector that has an output aperture, which allows emission of part of the converted light converted by the phosphor as emitted light, the retro-reflector reflecting another part of the converted light back to the phosphor as retro-reflection light,
wherein the phosphor includes a blue-light-ratio increasing member, which increases a blue light ratio of the converted light;

the blue light ratio increased by the bluelight-ratio increasing member is determined by Formula 1, below, relating to a colour temperature of the emitted light and a size of the output aperture:

$$CCT_{wr}(\alpha)=Y0+A1e^{BYR/t1}+A2e^{BYR/t2} \quad \text{(Formula 1)},$$

where factors Y0, A1, t1, A2, and t2 are dependent on an angle α representing the size of the output aperture of the retro-reflector, and BYR is a ratio between a blue light part and a yellow light part of spectra of the converted light from the phosphor.

6. The light source unit according to claim 1, further comprising:

a different pump light source that emits a different laser beam, wherein the phosphor converts the laser beam emitted from the pump light source and the different laser beam emitted from the different pump light source into the emitted light.

7. The light source unit according to claim 5, wherein the blue-light-ratio increasing member is scattering particles included in the phosphor to scatter the laser beam emitted from the pump light source.

8. The light source unit according to claim 7, wherein the scattering particles are formed from a high thermal conductivity material to improve thermal properties of the phosphor.

9. The light source unit according to claim 5, wherein the blue-light-ratio increasing member is the phosphor having a particle density adjusted in accordance with the size of the output aperture of the retro-reflector.

10. The light source unit according to claim 5, wherein the blue-light-ratio increasing member is a scattering layer disposed on a surface of the phosphor facing the pump light source to diffusely reflect or scatter the laser beam emitted from the pump light source.

11. The light source unit according to claim 5, wherein the blue-light-ratio increasing member is scattering particles disposed on a surface of the phosphor facing the pump light source to diffusely reflect or scatter the laser beam emitted from the pump light source.

12. The light source unit according to claim 5, further comprising:

a substrate that supports the phosphor, and wherein the blue-light-ratio increasing member is constituted of a combination of the substrate and the phosphor into a geometric pattern.

13. The light source unit according to claim 5, wherein the colour temperature of the emitted light is greater than or equal to 2000 K and smaller than or equal to 10000 K.

14. The light source unit according to claim 5, wherein the retro-reflector has a hollow dome shape or a flat plate shape.

15. The light source unit according to claim 5, wherein the retro-reflector is coupled to the phosphor directly or via an intermediate layer.

16. The light source unit according to claim 5, further comprising:

a different pump light source that emits a different laser beam, wherein the phosphor converts the laser beam emitted from the pump light source and the different laser beam emitted from the different pump light source into the emitted light.

* * * * *